US010980297B1

(12) United States Patent
Augustine et al.

(10) Patent No.: US 10,980,297 B1
(45) Date of Patent: Apr. 20, 2021

(54) PROTECTIVE FACE SHIELD WITH RESPIRATOR

(71) Applicant: Augustine Biomedical + Design, LLC, Eden Prairie, MN (US)

(72) Inventors: Scott D. Augustine, Deephaven, MN (US); Randall C. Arnold, Minnetonka, MN (US); Garrett J. Augustine, Deephaven, MN (US)

(73) Assignee: Augustine Biomedical + Design, LLC, Eden Prairie, MN (US)

( * ) Notice: Subject to any disclaimer, the term of this patent is extended or adjusted under 35 U.S.C. 154(b) by 0 days.

(21) Appl. No.: 16/941,947

(22) Filed: Jul. 29, 2020

Related U.S. Application Data

(60) Provisional application No. 63/036,086, filed on Jun. 8, 2020, provisional application No. 63/000,267, filed on Mar. 26, 2020.

(51) Int. Cl.

| | |
|---|---|
| ***A41D 13/11*** | (2006.01) |
| ***A62B 23/02*** | (2006.01) |
| ***A62B 18/02*** | (2006.01) |
| ***A62B 7/10*** | (2006.01) |

(52) U.S. Cl.
CPC ..... *A41D 13/1184* (2013.01); *A41D 13/1107* (2013.01); *A62B 7/10* (2013.01); *A62B 18/02* (2013.01); *A62B 23/02* (2013.01)

(58) Field of Classification Search
CPC ..... A41D 13/11; A41D 13/1107; A41D 13/1138–1146; A41D 13/1161–1192; A62B 7/10; A62B 9/02; A62B 18/00; A62B 18/02; A62B 18/08–084; A62B 18/10; A62B 23/00–025; A61M 16/06–0605; A61M 16/0683; A61M 16/208–209; A61M 2016/0661; A61M 2205/75–7518; A61M 2205/7581
See application file for complete search history.

(56) References Cited

U.S. PATENT DOCUMENTS

| | | | | |
|---|---|---|---|---|
| 5,647,060 | A * | 7/1997 | Lee | A41D 13/1184 2/9 |
| 2004/0221849 | A1* | 11/2004 | Shue | A62B 18/025 128/206.17 |
| 2016/0030779 | A1* | 2/2016 | Twu | A62B 7/10 128/202.13 |
| 2017/0050058 | A1* | 2/2017 | Konrad | A62B 23/02 |
| 2020/0094005 | A1* | 3/2020 | Sofranko | A61M 16/208 |

* cited by examiner

*Primary Examiner* — Rachel T Sippel
(74) *Attorney, Agent, or Firm* — Schwegman Lundberg & Woessner, P.A.

(57) ABSTRACT

A protective face shield with respirator including a face shield sized to cover some or all of the face and a respirator attached to the back side of the plastic shield. The respirator can include a substantially tubular, compressible foam mask with one end of the tubular mask bonded to the back side of the plastic shield and the other end of the tubular mask oriented rearward creating a rear surface for engaging with the face and surrounding the nose and mouth. The tubular mask can include at least one ventilation opening that traverse through the wall of the tubular mask and a ribbon (e.g., strip) of air filter media that wraps at least partially around the outside of the tubular mask covering some or all of the outside surface of the mask.

21 Claims, 20 Drawing Sheets

PROTECTIVE FACE SHIELD WITH RESPIRATOR

PRIORITY

This application claims the benefit of priority to U.S. Provisional Patent Application Ser. No. 63/000,267, filed Mar. 26, 2020 and to U.S. Provisional Patent Application Ser. No. 63/036,086, filed Jun. 8, 2020, all of which are incorporated by reference in its entirety.

TECHNICAL FIELD

This document pertains generally, but not by way of limitation, to systems and methods for improving safety of healthcare workers and other personnel by protecting them from airborne pathogens and contaminates.

BACKGROUND

There are many types of filtering facemasks (a formed piece of air filter material placed over the mouth and nose), filtering respirators (a sealed facemask with air filter) and face shields that have been developed over the last century to protect individuals from germs. Conventional devices have inherent problems and limitations due to their designs.

OVERVIEW

The present inventors have recognized, among other things that problems to be solved with protective wear, include a need for an improved face shield and facemask or respirator for health care workers and other personnel that is comfortable to wear, efficient and effective in filtration, forms an excellent seal with the user's face, is inexpensive, does not fog, can be cleaned and requires that only the filter be disposed of periodically ("periodically" is not necessarily after every contact with a infective patient). This same face shield/respirator or respirator alone could also have many other applications including, but not limited, to industrial, home and personal use. During a pandemic such as COVID-19 that is causing a world-wide shortage of personal protective equipment (PPE) such as face masks and face shields, a simple design that does not require long lead time tooling or custom long lead time manufacturing equipment is desirable.

There is a need for comfortable, high efficiency respirators in many walks of life, especially during a pandemic like Covid-19. For example, sports and entertainment events, airline flights, students and teachers in the classroom and activities of daily living such as going to the store. For some uses, full face and eye protection may not be necessary.

The present inventors have recognized that previous filtered facemasks, especially those for medical use during surgery for example, are intended primarily to protect the patient from the healthcare provider. In other words, filtered facemasks prevent airborne droplets that may contain bacteria and viruses from the clinician's mouth and nose, from spraying into an open surgical wound. To prevent droplets from aerosolizing outward, a tight seal around the nose and mouth is not necessary. Additionally, since the droplets are relatively large, filter material or filter media that is relatively inefficient in filtration is adequate. Absent a tight seal around the periphery of the nose and mouth and absent high efficiency filter media, these filter face masks provide very little protection for the healthcare provider trying to avoid airborne pathogens such as those airborne viruses present during the COVID-19 pandemic. Since these masks are facing toward the patient and can be directly contaminated by infectious airborne droplets and fluids from the patient, they should be discarded between patient contacts, especially if the patient is thought to be contagious. The need for discarding masks between each patient contact has caused a critical shortage of these masks.

Higher filter efficiency facemasks such as so-called N-95 and N-100 masks are also available. In addition to high efficiency filter media, these masks are also designed to create a better seal around the nose and mouth. Most of these high efficiency masks are a molded design and are somewhat inflexible, requiring specific fitting to the user's face. If the mask is not properly fitted and is not tightly applied, usually with two elastic bands behind the head and neck, air can leak around the periphery, which entirely negates the purpose of the high efficiency filter media. The tight fit of these masks makes them uncomfortable for prolonged use and the accumulation of moisture in the filter media degrades the filtration efficiency. These mask are well known to leak air between the mask and face even under the best circumstances. During the COVID-19 pandemic these masks are in critically short supply and production cannot be acutely increased because they are made on large, expensive custom built automated manufacturing machines that require a year or more of lead-time to construct. Since these masks face the patient and can be directly contaminated by infectious airborne droplets and fluids from the patient, they should be discarded between patient contacts, especially if the patient is thought to be contagious. The need for discarding between patient contacts, especially if the patient is thought to be infected and the limited short term increase production, has caused a critical shortage of these masks.

The inventors have also recognized that previous respirators, with or without eye protection, have been around since WWI. These generally comprise a facemask made of rubber or plastic that fits over the nose and mouth. Air filter media is either incorporated into the facemask or as a canister attached to the front or side of the facemask. In some cases, especially in "gas masks" or "hazmat" applications, a face shield or goggles and total head cover will be attached to the upper side of the respirator to protect the eyes. Respirators tend not to be used in healthcare applications because they are uncomfortable, hot, the goggles or shields fog. Additionally, they are too expensive to use as a disposable after contamination and yet the inner channels and ports may or may not be cleanable. Since all of these designs have the filter media exposed and facing generally toward the patient, the filters can be directly contaminated by infectious airborne droplets and fluids from the patient. While the filters can be discarded between patient contacts if the patient is thought to be contagious, the filter housing and the rest of the respirator may not be cleanable.

The inventors have also recognized that previous face shields have been available for health care use for many decades and much longer in industrial applications. The most common face shield is a piece of clear plastic sheeting that is attached on its upper edge to a headband worn by the clinician or industrial worker. These shields are designed for eye protection and thus usually hang down to approximately the level of the nose—they generally do not cover the entire face. In health care applications, the user is generally wearing a filtered facemask of some sort over their nose and mouth and a face shield covering their eyes. The user's exhaled humid, warm breath rises behind the face shield and distorts the user's vision by fogging the shield and/or the user's glasses.

Face shields have also been attached to the upper edge of filtered facemasks in order to cover and protect the user's eyes. These not only suffer from all of the limitations of filtered face masks but also the shields are easily fogged by exhaled humid, warm breath leaking from the top of the mask and rising behind the face shield.

In some examples of this disclosure, a protective face shield with respirator is an apparatus that protects the entire face of the health care provider, general consumer or industrial user with a clear plastic shield. Attached to the back side of the shield is a respirator that provides highly filtered air to the user. The respirator is protected from airborne droplet contamination from the patient by the shield, allowing the respirators' filter to last longer between changes.

In some examples, the protective face shield is made of a relatively stiff, clear plastic sheet material sized to extend roughly from the top of the head to below the chin and wrap roughly from one cheek to the other, forming a shield in front of the face. In some examples, the protective face shield covers the five orifices that are susceptible to airborne virus inoculation: two eyes, two nostrils and the mouth. In some examples, the front surface of the protective face shield is entirely smooth, making cleaning very easy. In some examples, the front surface of the protective face shield is substantially smooth with the exception of an expiratory valve or a tie strap anchor for example.

In some examples, a respirator is attached to the back side of the face shield—the side facing the user. In some examples, the respirator comprises a facemask and a high efficiency filter. In some examples, the facemask is made of a substantially tubular piece of compressible rubber or plastic foam material. One open end of the tubular foam material is bonded to the back side of the face shield. The other open end of the tubular foam material opens rearward to engage the user's face, surrounding the nose and mouth. In some examples, straps or strings attach near the lateral edges of the face shield and are tied or connected by other means behind the user's neck or head. When the straps are tightened, the face shield and tubular foam facemask are pulled toward the user's face, making a substantially airtight seal with the face surrounding the nose and mouth. When the straps are tightened, the face shield bends around the users face and the tubular foam facemask attached to the shield is morphed (e.g., deformed, elastically deformed) from a substantially round configuration of the shield attachment side to an oval configuration of the side engaging the face. The oval configuration improves the airtight seal with the face surrounding the nose and mouth by augmenting the pressure applied to the cheeks where facemask leaks frequently occur.

In some examples, the facemask includes at least one ventilation opening (e.g., hole, aperture) that extends from the inner surface of the tubular foam material, through to the outer surface of the tubular foam material. This opening allows the ventilation air to pass from the inner chamber of the facemask, outward during exhalation and inward during inhalation to provide fluid communication between a user and the environment to allow a specified passage of gases. In some examples, the fluid communication allows a specified passage of one or more of: fluid, gas, moisture, vapor or liquid. The tubular foam facemask is easy to make, comfortable for the user, provides separation and a secure mounting platform for the face shield to be suspended in front of the user's face. The tubular foam facemask also allows ventilation airflow to occur in a lateral direction, inspired air entering from the protected space formed between the face shield and the face of the user. In some examples, supporting bushings may be inserted into at least one ventilation opening to prevent collapsing when the straps are tightened pulling the mask snugly against the user's face.

In some examples it may be advantageous to attach one or more expiratory valves to the facemask, preferentially allowing very low resistance air egress from the mask. Expiratory valves can include any suitable type of valve such as Heimlich valves, duckbill valves and flapper valves. One advantage of including an expiratory valve is that exhaled moisture in the facemask in minimized and only inhaled air transits the filter media, keeping the filter media dry and efficient in filtration.

In some examples, a filter can include a ribbon-like strip of air filter media or filter material is formed into a tubular shape that is sized to wrap snuggly around the tubular foam material of the facemask. The tubular filter media covers at least one ventilation opening in the facemask and thus filters the air entering and exiting through the opening in the facemask. In some examples, the tubular filter media is wider than the tubular foam material of the facemask and extends beyond the face-engaging end of the tubular foam material. The extension of tubular filter media provides a secondary seal with the user's face, thus allowing the face mask to be applied to the face with much less force than traditional facemasks. The ribbon-like strip of air filter media may be formed into a tubular shape by sewing or gluing the ends of the ribbon-like strip together. The resulting filter is inexpensive yet highly efficient and seats snuggly around the tubular compressible foam facemask without requiring the stiff mounting frames necessary for most removable filters.

In some examples, the at least one opening in the facemask can be positioned in only a portion face mask, such as one or more of the upper portion or lower portion of the mask, or one or more of lateral sides of the face mask, and any combination thereof. In such an example, the filter media may be conserved by limiting the ribbon of filter media to cover only a portion of the outer perimeter. Such an amount is not limited to covering the entire outer perimeter or circumference of the mask, but may cover at least an outer portion of the facemask that includes the ventilation opening. In this example, the remainder of the circumference or perimeter of the mask may be surrounded by a ribbon of fabric, foam or elastic. The ends of the two materials may be joined together to form a tubular structure that surrounds the facemask and covers the ventilation openings with filter media. In some examples, the ribbon of filter media may be attached to the facemask with adhesive, hook and loop fastener or other mechanical fasteners.

In some examples, the ventilation openings enter the mask through the shield attached to the front of the mask. In this example there may not be ventilation openings through the walls of the facemask itself. In some examples, a molded filter canister with a removable filter may be attached to the front side of the shield and the filter canister may be in fluid connection with the interior of the mask by way of one or more ventilation openings through the shield. In some examples, the filter canister has a fluid impermeable cover that protects the filter from droplets of blood, fluid or ventilation aerosols. The ventilation air may be able to enter the filter canister from the sides or bottom but not through the cover. In some examples, the filter canister may include an expiratory exhalation valve so that exhaled air does not have to pass through the filter.

In some examples this protective face shield and facemask are easily cleanable and thus reusable. In some examples the high efficiency tubular filter is easily replaced and is disposable.

In some examples, this protective face shield with respirator includes one or more fog diversion wings. In an example, the one or more fog diversion wings can include two fog diversion wings with one located on each side of the respirator. In some examples, a fog diversion wing can include a piece of compressible rubber, plastic foam, or any other suitable polymeric material. The fog diversion wing can be located adjacent to the back side of the face shield. In some examples, the fog diversion wing is attached to the back side of the face shield. The fog diversion wing can be designed to be adjacent to, such as to abut the tubular filter media on the outside of the facemask and/or abut the user's cheek and project substantially laterally from the facemask. The fog diversion wings physically prevent warm, humid, exhaled air from rising up and into the field of vision, fogging the face shield or the user's glasses. The fog diversion wings can also improve the stability of the shield against the user's face and prevent the shield from over flexion when the tie strings or another attachment member is pulled tight.

DETAILED DESCRIPTION

The following detailed description is exemplary in nature and is not intended to limit the scope, applicability, or configuration of the invention in any way. Rather, the following description provides practical illustrations for implementing exemplary examples of the present invention. Examples of constructions, materials, dimensions, and manufacturing processes are provided for selected elements, and all other elements employ that which is known to those of skill in the field of the invention. Those skilled in the art will recognize that many of the examples provided have suitable alternatives that can be utilized.

Figure 1:
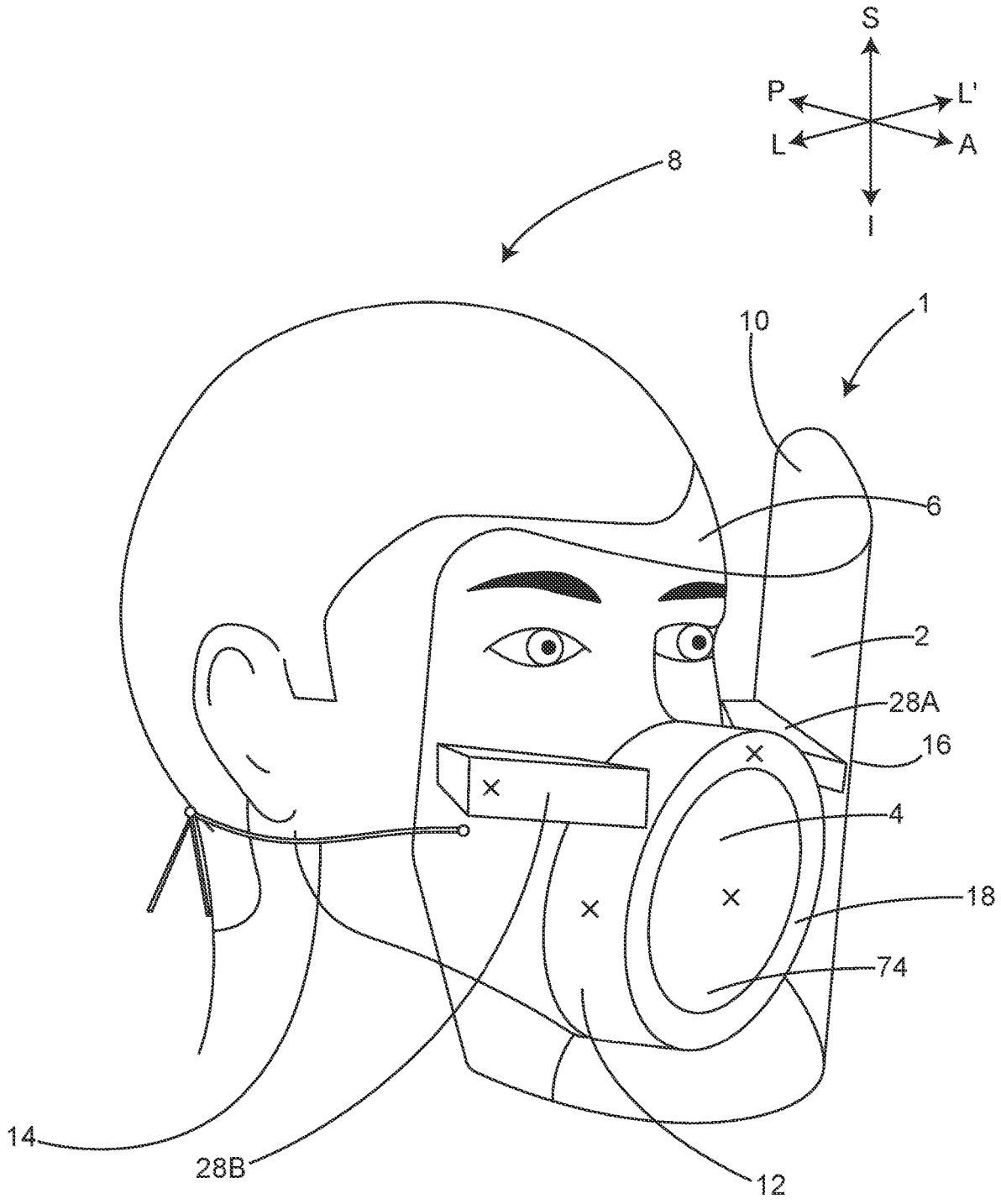
FIG. 1 shows a perspective view of a device including a protective face shield with a respirator on a user, in accordance with at least one example.

Directional descriptors are used within their ordinary meaning in the art. FIG. 1 includes an axis showing the anterior A and posterior P directions, as well as the lateral directions L and L', and superior S (e.g., top) and inferior I (e.g., bottom) directions, which are defined when the device 1 is worn on a head of a user with the device in an upright orientation with respect to a ground as shown in FIG. 1. Opposite to the lateral directions L and L', is the medial direction, in other words, the medial direction is towards the centerline, or a vertical longitudinal axis of the device 1 (FIG. 1).

Together, FIGS. 1-8 show and describe an illustrative embodiment of a device 1 including a protective face shield 2 with a respirator 4. FIGS. 1-8 will be described together. Aspects of the device 1 of FIGS. 1-8 can be used interchangeably with aspects of other examples disclosed herein. Like numerals may represent like elements throughout, and therefore elements may be introduced in one figure but may not be further described in all the figures in which the element or variations of the element are shown.

Figure 2:
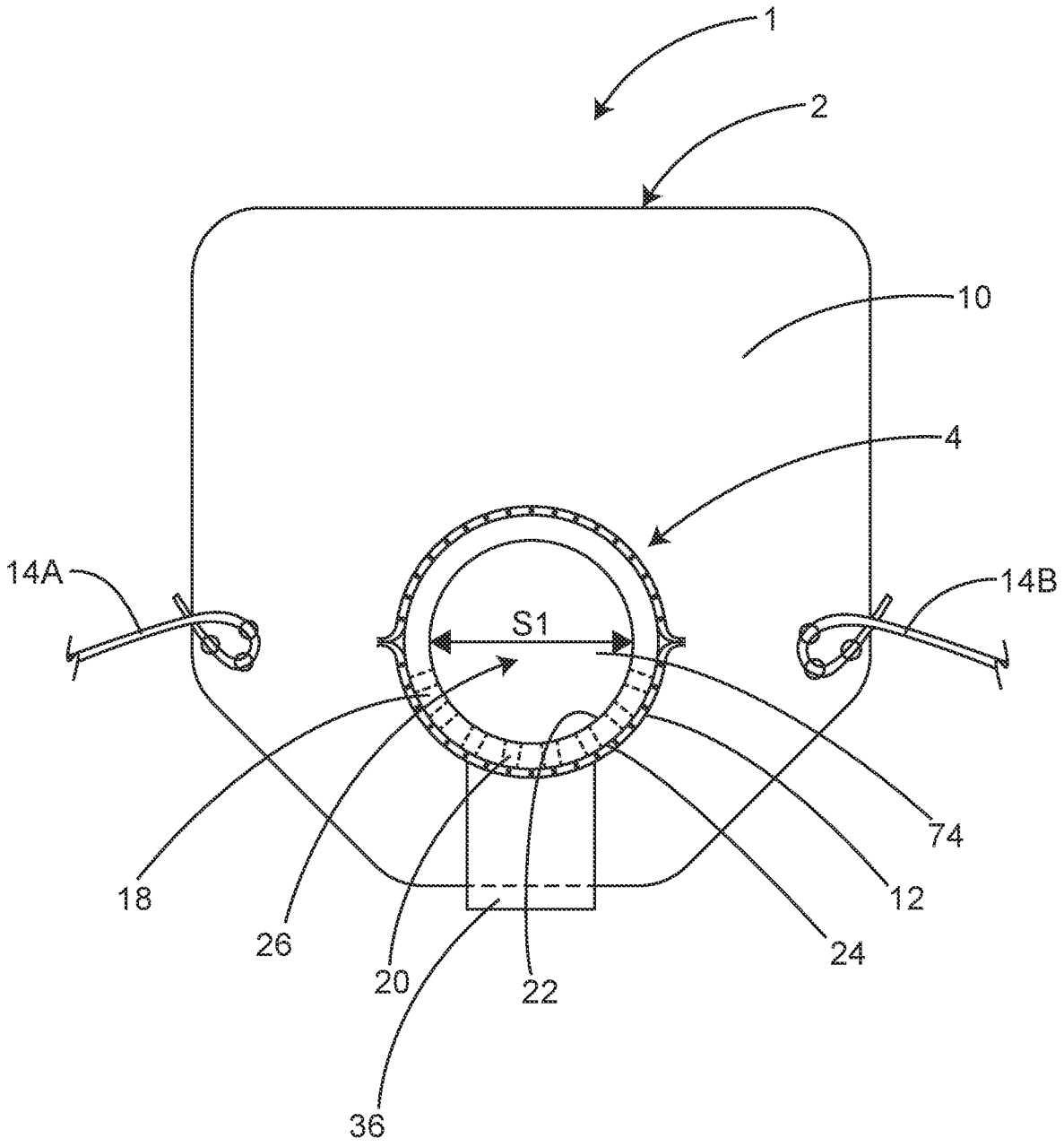
FIG. 2 shows a back view of a portion of the device of FIG. 1 and including an optional expiratory valve, in accordance with at least one example.
Figure 3:
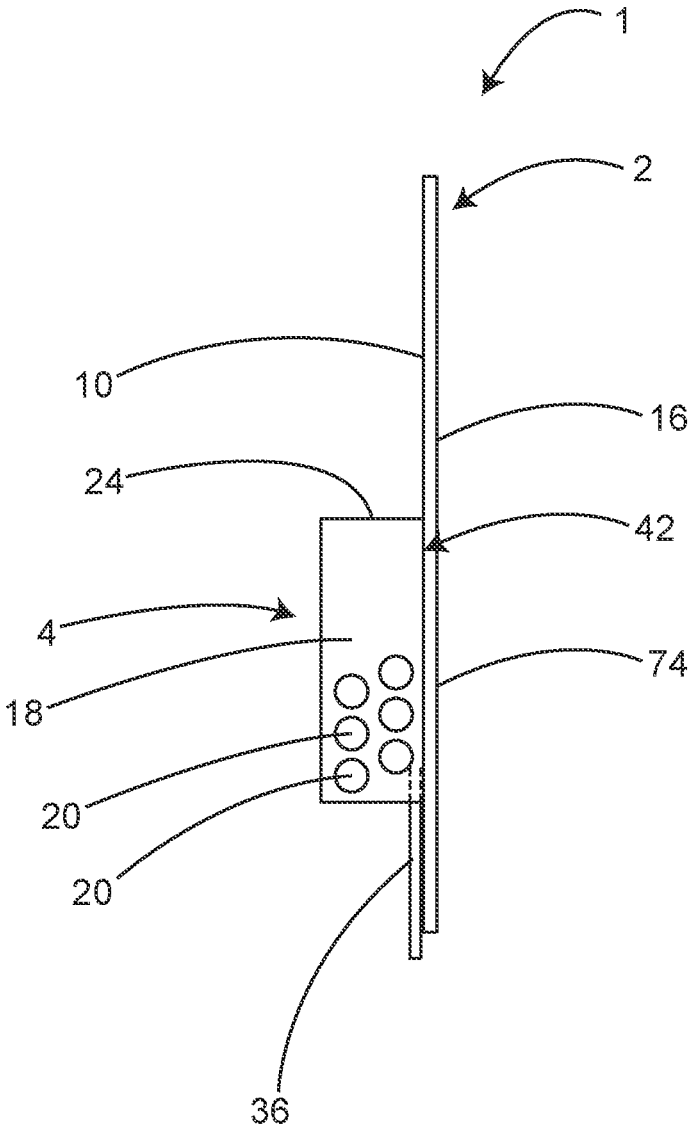
FIG. 3 shows a side view of a portion of the device of FIG. 2, in accordance with at least one example.
Figure 4:
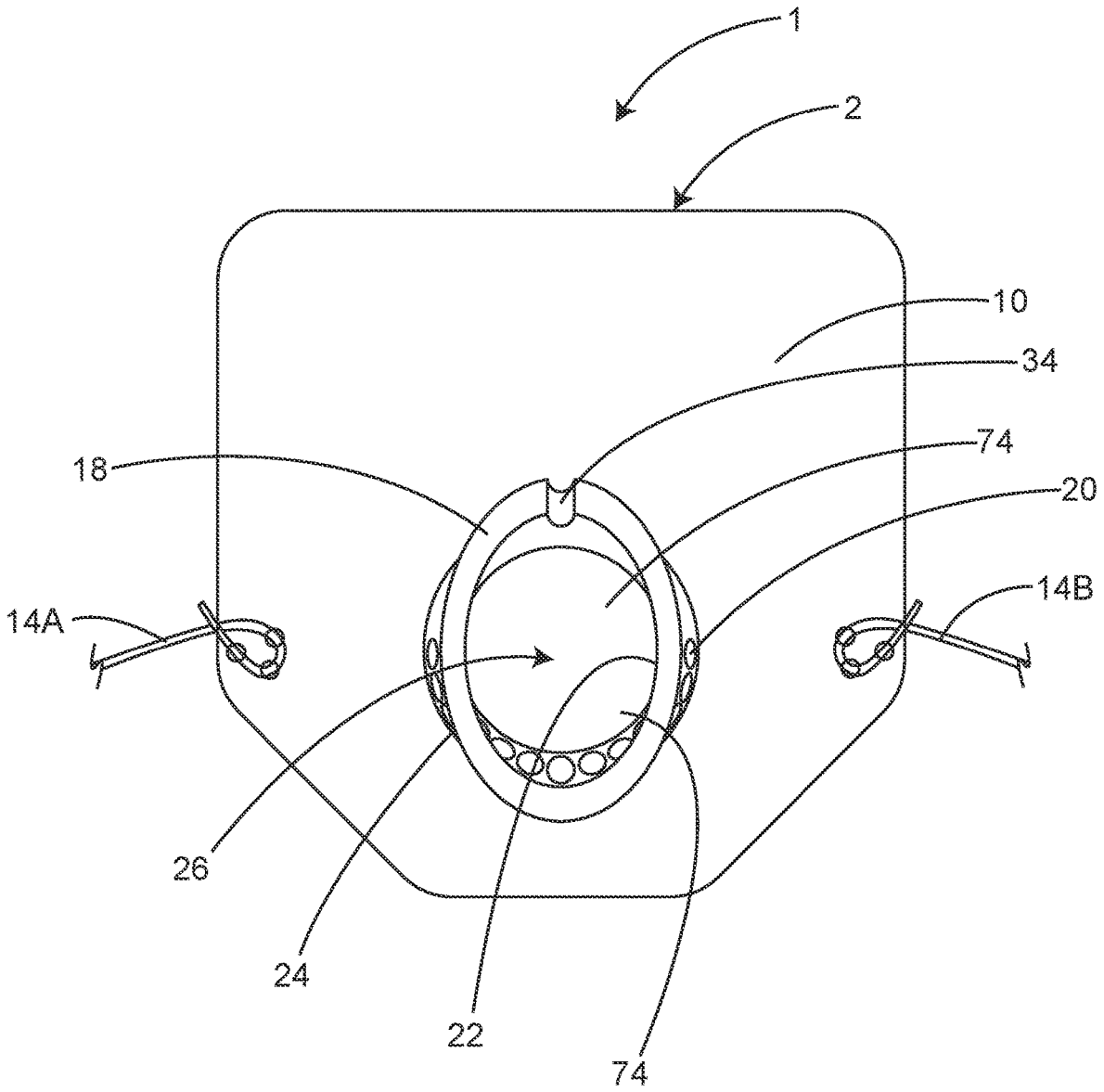
FIG. 4 shows a back view of a portion of the device of FIG. 1, and in a state when the respirator is bent around a face (not shown), in accordance with at least one example.
Figure 5:
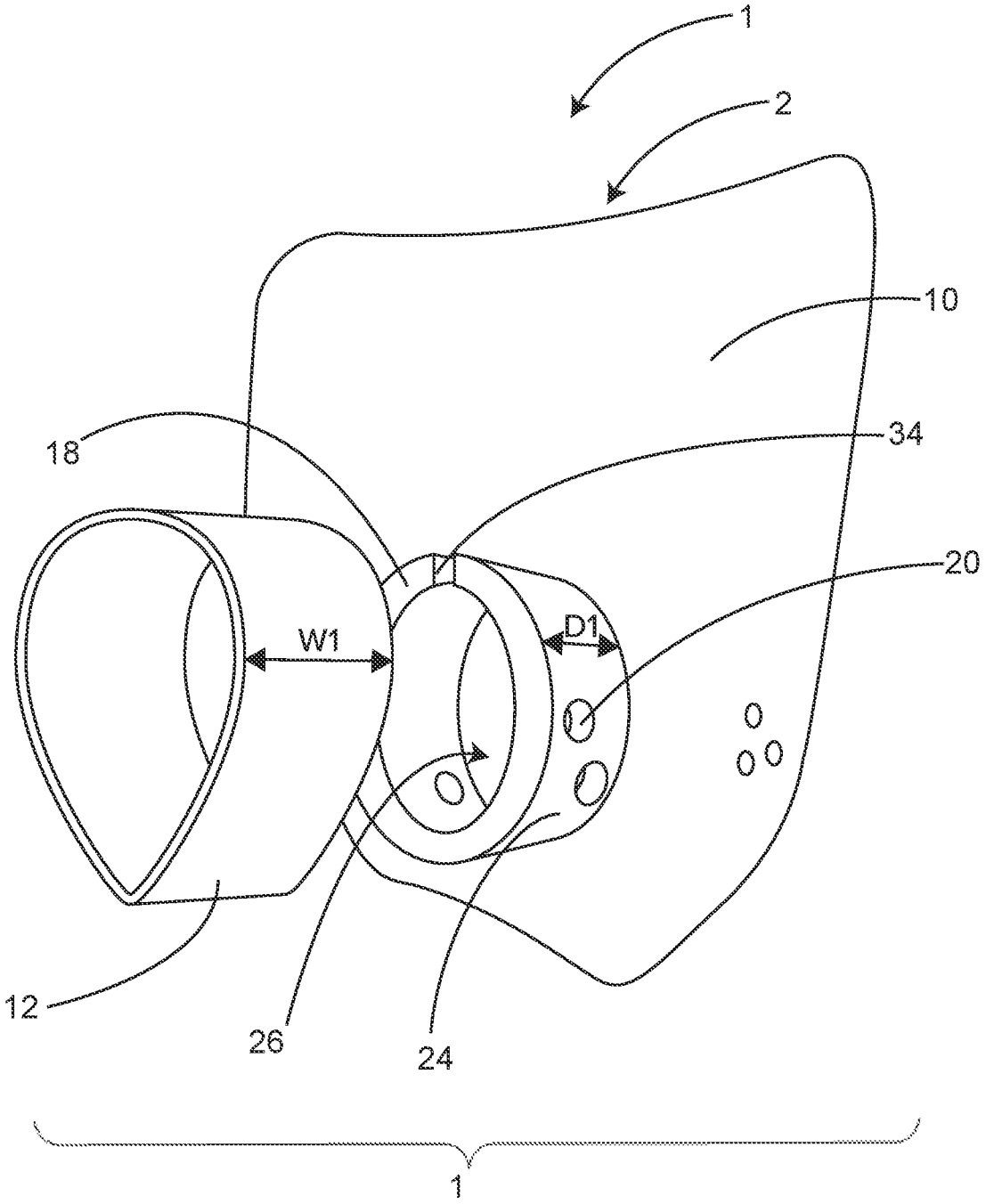
FIG. 5 shows a perspective view of a portion of the device of FIG. 1 with the filter unattached, in accordance with at least one example.
Figure 6:
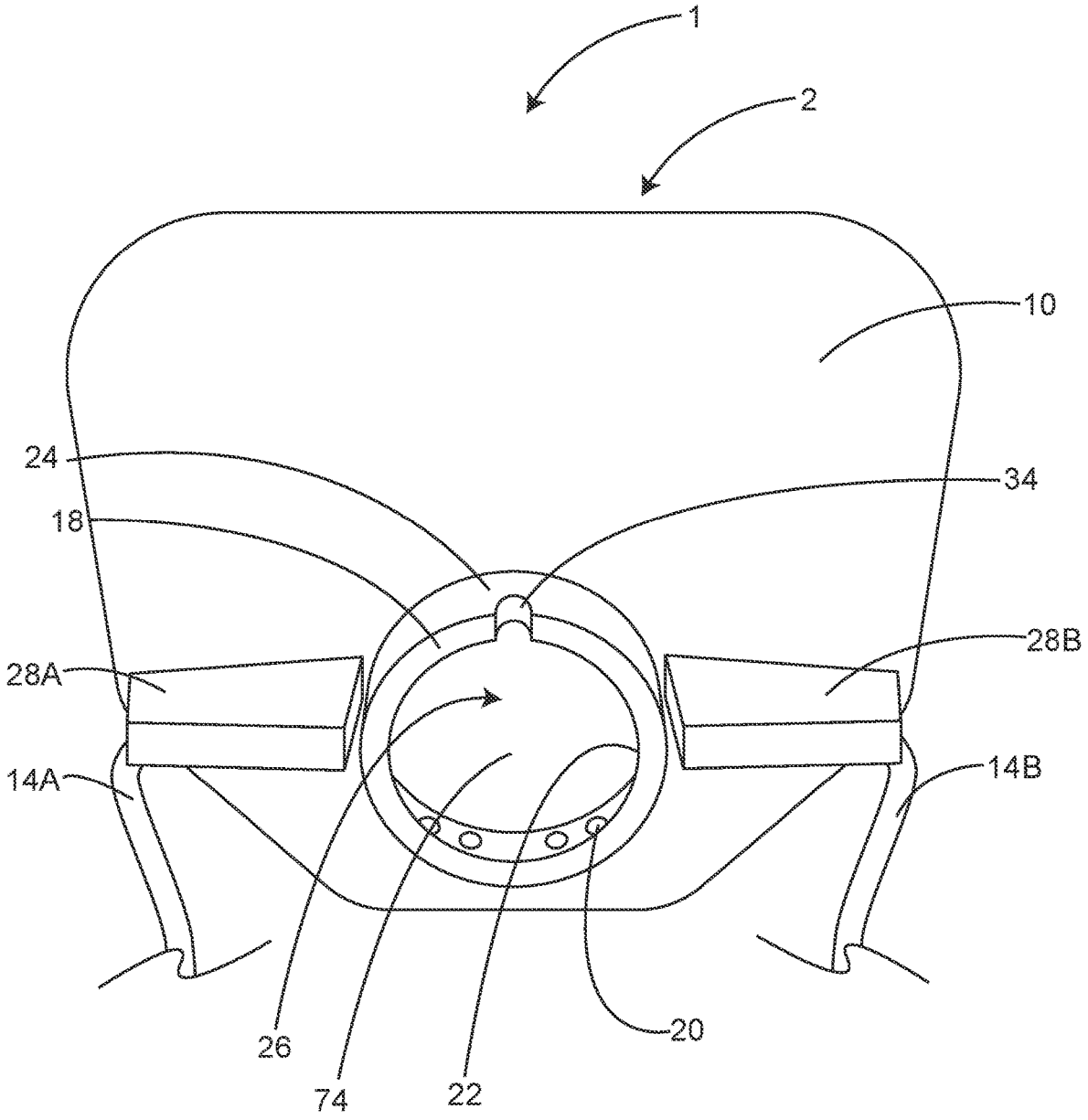
FIG. 6 shows a back view of a portion of the device of FIG. 1 in a relaxed state, in accordance with at least one example.
Figure 7:
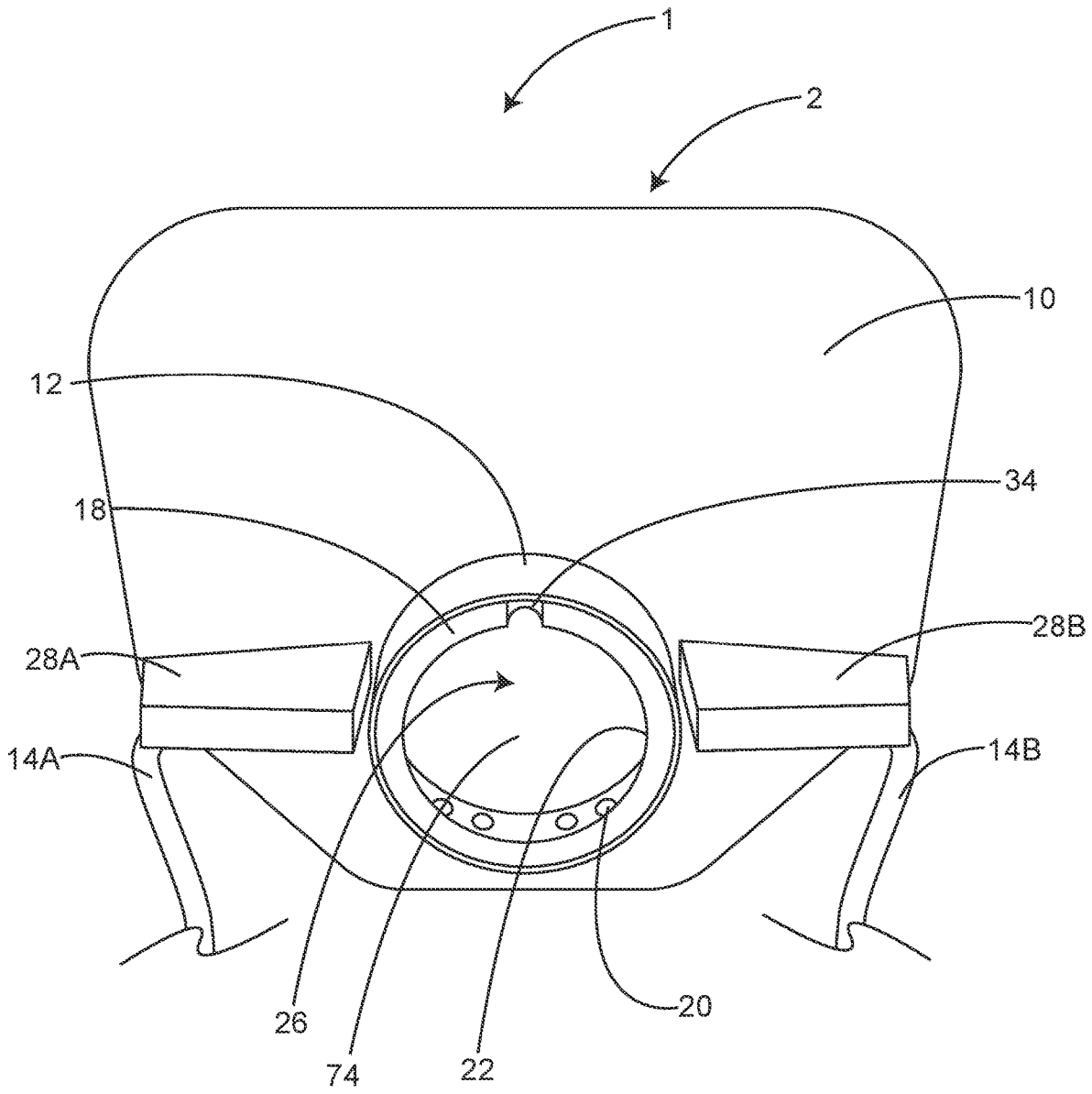
FIG. 7 shows a back view of the device of FIG. 1 in the relaxed state, in accordance with at least one example.
Figure 8:
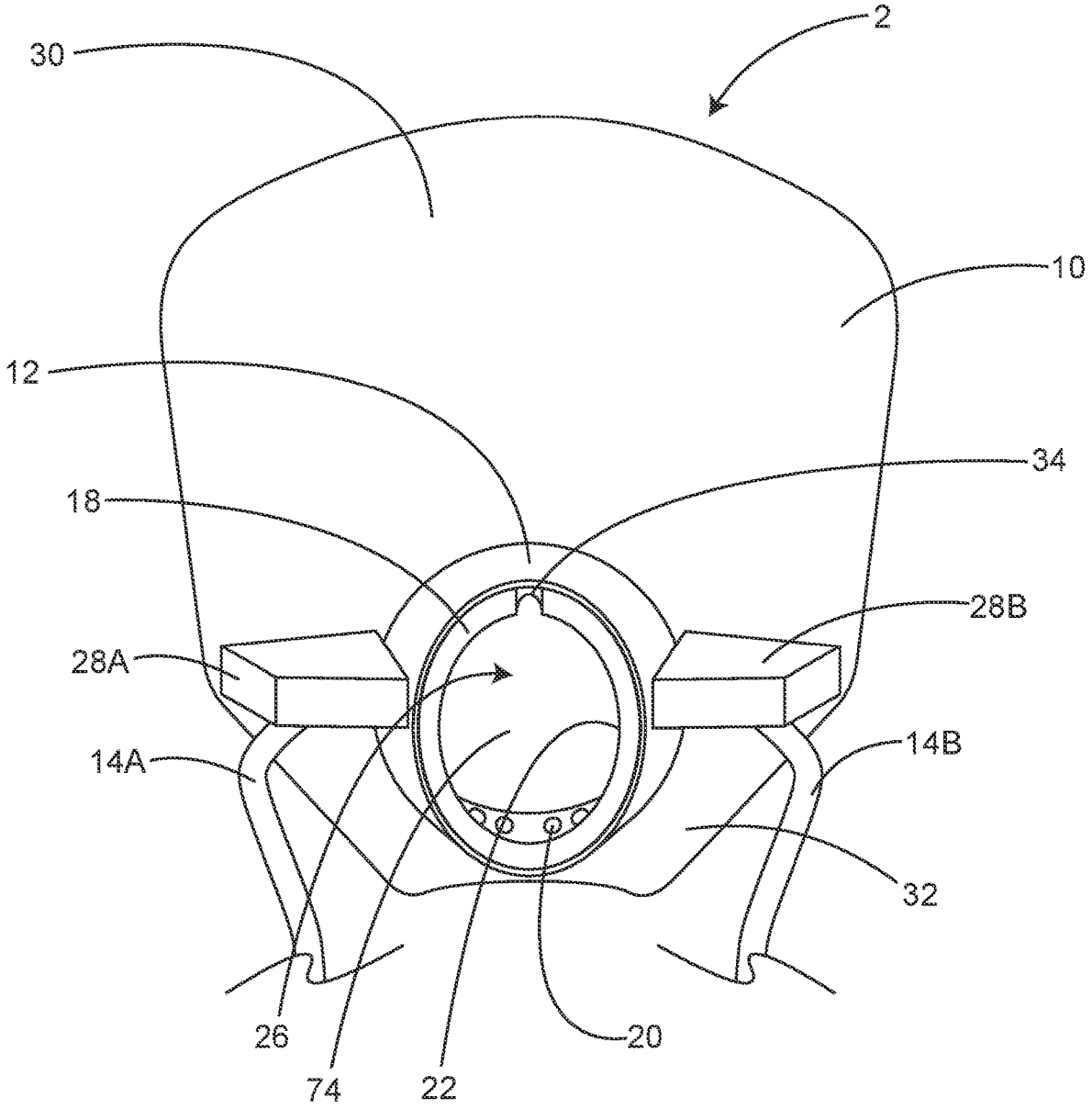
FIG. 8 shows a back view of the device of FIG. 1 when bent around a face (not shown), in accordance with at least one example.

FIG. 1 shows a perspective view of the device 1 worn by a user. FIG. 2 shows a back view of a portion of the device 1 including an optional expiratory valve. FIG. 3 shows a side view of a portion of the device 1 including the optional expiratory valve. FIG. 4 shows a back view of the a portion of the device 1 without the optional expiratory valve, and in a state when a respirator is bent around a face (not shown). FIG. 5 shows a perspective view of a portion of the device 1 with the filter unattached. FIG. 6 shows a back view of the device 1 of FIG. 2, in the relaxed state without a filter. FIG. 7 shows a back view of the device 1 in the relaxed state with a filter 12. FIG. 8 shows a back view of the device 1 when bent around a face (not shown) with the filter 12. FIGS. 1-8 illustrate aspects of a device 1 in accordance with at least one example.

As shown in FIG. 1, the device 1 can protect the face 6 of a user such as a health care provider, general consumer or industrial user 8 with the transparent shield 2 such as a clear plastic (e.g., polymeric) shield. In some examples the shield 2 can be configured to protect the entire face of the user. A respirator 4 that provides highly filtered air to the user 8 can be attached to the back side 10 of the shield 2. In this location, the respirator 4 can be protected from airborne droplet contamination from the patient by the shield 2, that can, under some circumstances, allow the respirators' filter 12 to be used multiple times before being discarded. Protecting the respirator 4 from patient contamination by "hiding" it behind the face shield 2 is fundamentally different than conventional respirators that face generally toward the patient.

In some examples, the protective face shield 2 can be made of a clear plastic sheet material sized to extend roughly from the top of the head to below the chin and wrap roughly from one cheek to the other, forming a shield in front of the face 6. In some examples, the protective face shield 2 covers the five orifices that are susceptible to airborne virus inoculation: two eyes, two nostrils and the mouth. In some examples, the clear plastic sheet material is relatively stiff yet bendable (e.g., elastically deformable, substantially elastically deformable, during use) into a simple curved shape so that the shield 2 advantageously wraps around the face 6 when at least one user attachment 14, such as tie strings or other attachment members, are tighten behind the user's 8 neck or head. Wrapping the face shield 2 around the face 6 gives added protection preventing contaminates from reaching the user's face 6 from the side as compared to conventional face shields. The device 1 can be configured such that the face shield wraps around the face 6 in close proximity to the face 6, or in some examples, directly adjacent to the face 6 or other portion of the user's head to provide additional protection.

A problem that the inventors have recognized is that respirators and face masks muffle sound, making it difficult for the wearer to be understood when speaking. To improve sound transmission of the user's voice, the protective face shield 2 can be made of a material that acts as a sound-resonating diaphragm 74 to transmit sound from the inner chamber 26 of the respirator 4 (FIGS. 2, 4-8) to the outside of the respirator 4, such as a polymeric sheet material. The tubular foam facemask 18 can be adhesively attached to face shield 2 creating the functional equivalent of a diaphragm on a loudspeaker or a drumhead. Hard plastic sheet materials such as polyethylene terephthalate (PET), polyethylene terephthalate glycol-modified (PETG) and polycarbonate can vibrate and resonate in response to the sound waves created by the wearer's voice. The vibrating sound-resonating diaphragm 74 then re-transmits the sound waves to the air outside the respirator 4 with relatively little loss of volume or distortion.

The sound-resonating diaphragm 74 design of this disclosure projects the spoken sound of the user for better understanding. This ability to project un-muffled sound is particularly important in healthcare and emergency settings where accurate and understandable communication is essential. The ability to project un-muffled sound is also advantageous in settings such as athletic events to allow crowd cheering.

Existing face shields that are worn over a separate respirator do not provide the same benefit, because the filter material of the respirator, which muffles sound, is located between the mouth of the wearer and a separate face shield, thus the sound remains muffled by the respirator. In contrast to the muffling of sound, the facemask 18 can form a chamber (e.g., inside of respirator 26) configured to constrain and direct the sound waves exiting a wearer's mouth, directing the sound waves away from the user in direction anterior A of the user's mouth. The face shield 2 can be configured to receive the constrained, directed and substantially unmuffled soundwaves and transmit them through the protective face shield 2.

To further describe the sound transmitting features of the device 1, FIG. 4 shows a back view of a portion of the protective face shield 2 with the respirator 4 in a worn state, bent around a face 6 (face not shown for clarity, but shown in FIG. 1). As shown in FIG. 4, the facemask 18 can be configured to deform into a shape having aspects of a cone in a speaker when worn. This shape can be favorable for transmitting sound waves anteriorly through the chamber of the facemask 18. The shape of the facemask 18 can have at least a portion that tapers from a narrower portion to a wider portion when worn. For example, when worn, the facemask 18 can have a narrower proximal portion in the medial-lateral direction proximate the face of the user and a wider distal portion in the medial-lateral direction distal of the face of the user. In the unworn state (or when the shield 2 is in a planar state, or prior to attachment of the facemask 18 to the shield 2), the facemask 18 can have a relatively consistent dimension or diameter from the proximal portion to the distal portion compared to the worn state.

In addition to protecting the user from airborne particles, the curved shield 2 wrapping around the face 6 prevents the user from inadvertently touching their own face with their own potentially contaminated hands. It is well known that face touching and mask-adjusting with contaminated hands is perhaps the healthcare provider's greatest risk for personal contamination. In some examples, it is difficult to reach your own face when wearing the shield of this disclosure and touching your face becomes an intentional move rather than the unthinking scratching of an itch, for example. The face shield 2 of this disclosure not only protects the user against potentially inhaled contaminates but also decreases the chances of self-contamination from their own contaminated hands. The mask 18 can be adjusted by holding on to the face shield 2, obviating the need to touch the mask 18 during adjustment of mask 18 on the face.

Many clear (e.g., transparent) plastic materials are suitable for the face shield 2. These include but are not limited to polyester (PET and PETG) and polycarbonate. In some examples, the thickness of the face shield 2 material may be between 8 mil (0.008 inch) and 20 mil (0.02 inch) but other thicknesses are anticipated. In some examples, the preferred thickness of the face shield 2 may be 10 mil (0.01 inch).

In some examples, the protective face shield 2 can be made by a simple and inexpensive die-cutting process but other cutting processes are anticipated. In some examples, the protective face shield 2 is a flat piece of plastic that can be pulled into a curved shape by the user attachments 14 that are anchored to the face shield 2 near each side edge and that are tightened behind the user's 8 neck, head or ears. In some examples, the protective face shield 2 may be thermoformed to produce a bend, curve or crease, in order to accentuate the coverage along the sides of the face 6. In the examples, the face shield 2 is shown as protecting the face laterally and/or superiorly-inferiorly beyond the facemask 18. However, in some examples, the faces shield 2 may protect the mouth area, and may not extend substantially beyond the face mask 18 in the lateral L and/or the superior-inferior S-I directions (directions shown in FIG. 1), or may not extend beyond the facemask 18 in a lateral L and or superior-inferior I direction at all. For example, the face shield 2 can extend between 0-30% of the facemask 18 cross-section along a lateral L and/or superior-inferior direction S-I beyond the outer perimeter the facemask 18. In a perhaps more preferred example, the face shield 2 can extend between 5-30% beyond the facemask 18. This may be advantageous in non-medical settings, such as in schools where the need for a teacher to be heard is great, but extensive coverage of the face 6 is less of a concern.

Figure 11:
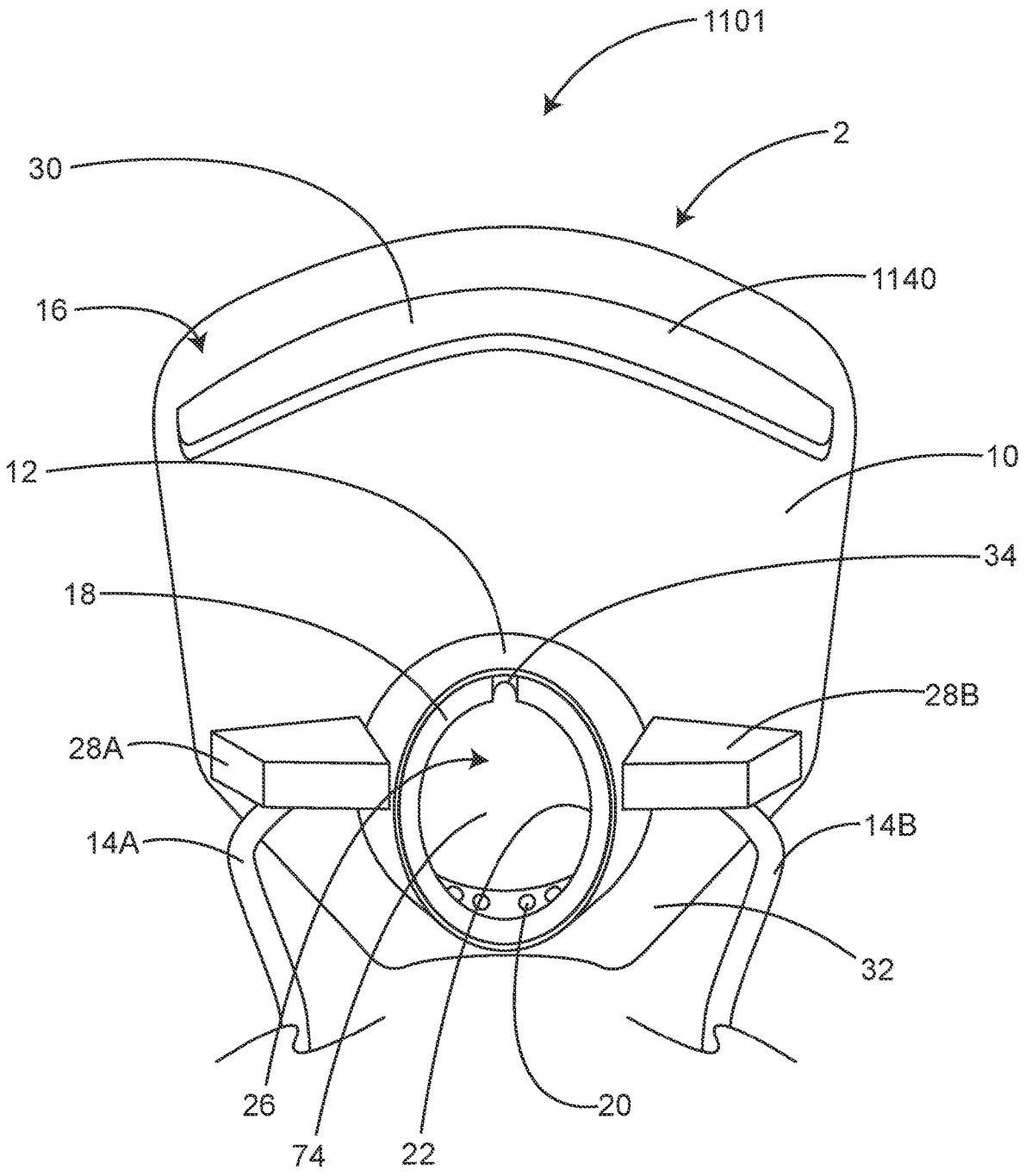
FIG. 11 shows a back view of a fourth example of a device including a protective face shield and a respirator, in accordance with at least one example.

FIG. 11 shows a back view of a fourth example of a device 1101 including the shield 2 and facemask 18. In some examples as shown in FIG. 11, a visor 1140 may be attached near the upper edge of shield 2. Visor 1140 may be cut in a curved shape to help create the curved shape of the shield 2 that is especially protective of the user's face 6 because it wraps around the sides of the user's face 6. The visor 1140 may or may not be designed to contact the user's forehead. Forehead contact of the visor 1140 may impede the facemask 18 seal against the face 6 on some users. In some examples, the visor 1140 may beneficially prevent airborne contaminating particles from entering behind the shield 2 from above. A small air gap between the visor 1140 and the user's forehead may be protected from external contamination because a convection current of warm air rises from the user's face and escapes through the gap between the visor 1140 and the forehead. The upward movement of air through the gap between the visor 1140 and the forehead can prevent airborne contaminants from entering through the gap. The visor 1140 may also prevent glare from overhead lights, reflecting in the field of vision on the shield 2.

In some examples the visor 1140 may be made of flexible, closed cell foams including but not limited to: polyurethane, polyethylene, PVC, neoprene or viscoelastic foams. The visor 1140 may be between 0.25 and 0.5 inches. thick. In some examples the visor 1140 may be approximately 0.375 inches thick. The visor 1140 may be attached to the shield with pressure sensitive adhesive (PSA) or other suitable adhesives.

In some examples the visor 1140 may be attached to the face shield 2 by first applying two-faced PSA to the outer curved edge. The visor 1140 may then be held in its preferred shape by a manufacturing jig with the taped edge facing upward. Finally, the face shield 2 may be lowered onto the visor 1140 securing the two together with the PSA. In contrast, attempting to apply the visor 1140 to the face shield 2 frequently results in wrinkles and misapplications.

In some examples, the front surface 16 of the protective face shield 2 can be mostly or entirely smooth, with no crevasses, cracks, holes or attached features, making the front surface 16 of the face shield 2 very easy to wipe clean between each patient, if necessary.

In some examples, the front surface 16 of the protective face shield 2 is mostly smooth with the exception of an optional expiratory valve or an anchor to affix the face mask 18 to the face shield 2, such as a tie strap. Examples of expiratory valves (e.g., 36) are shown in FIGS. 2-3 and 15-18. The expiratory valve may be a flap valve for example that closes against an aperture or hole through the face shield 2 or closes against a frame attached to an aperture or hole through the face shield 2. The expiratory valve may allow exhaled air to easily escape from the inner chamber 26 of facemask 18, minimizing humidity and moisture buildup in the facemask 18.

FIG. 2 shows a back view of a portion of the protective face shield with respirator of FIG. 1 and including an optional expiratory valve. FIG. 3 shows a side view of a portion of the protective face shield with respirator of FIG. 2. As shown in FIGS. 2 and 3, a respirator 4 can be attached to the back side 10 of the face shield 2—the side facing the user 8 (not shown). In some examples, the respirator 4 comprises a facemask 18 and a high efficiency filter 12. At least a portion of the filter 12 can include filter media. In some examples described herein, the terms filter and filter media are used interchangeably, however, in examples described herein, all or just a portion of the filter 12 can be formed of filter media. In some examples, the facemask 18 can include a substantially tubular piece of compressible rubber or plastic foam material. In some examples the facemask 18 may not be tubular, and/or may be discontinuous. The foam facemask 18 may be molded in a tubular form or be a strip of foam material with the ends joined together to form a tubular structure. In some examples it can be beneficial to construct the foam facemask 18 from a strip of foam material with the ends joined together because the strip of foam material can be easily and inexpensively die cut or cut by other cutting processes, without requiring expensive tooling and molds.

Figure 12:
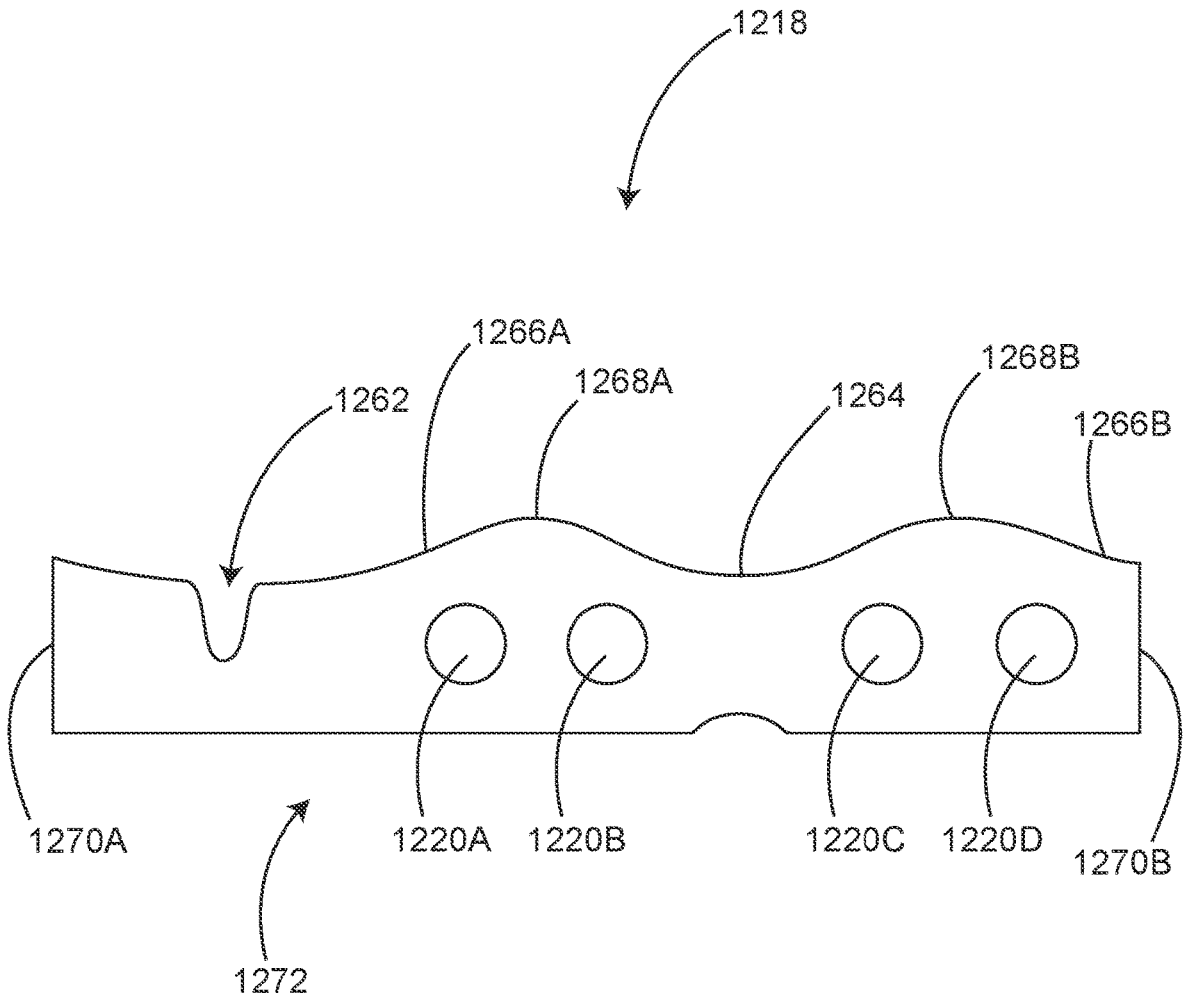
FIG. 12 shows a side view of a second example of a face mask in an unassembled state, in accordance with at least one example.
Figure 13:
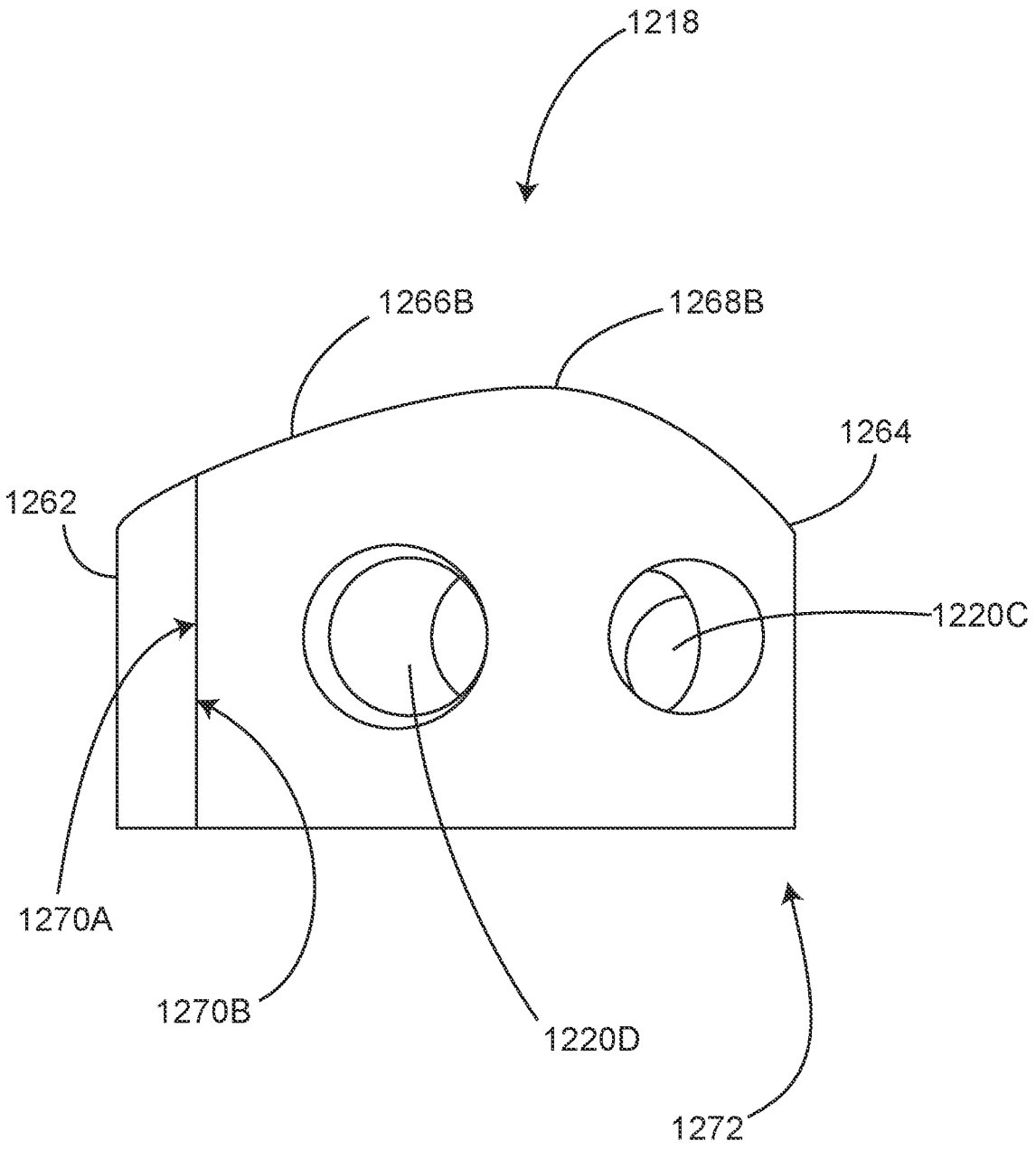
FIG. 13 shows a side view of the face mask of FIG. 12 in an assembled state, in accordance with at least one example.
Figure 14:
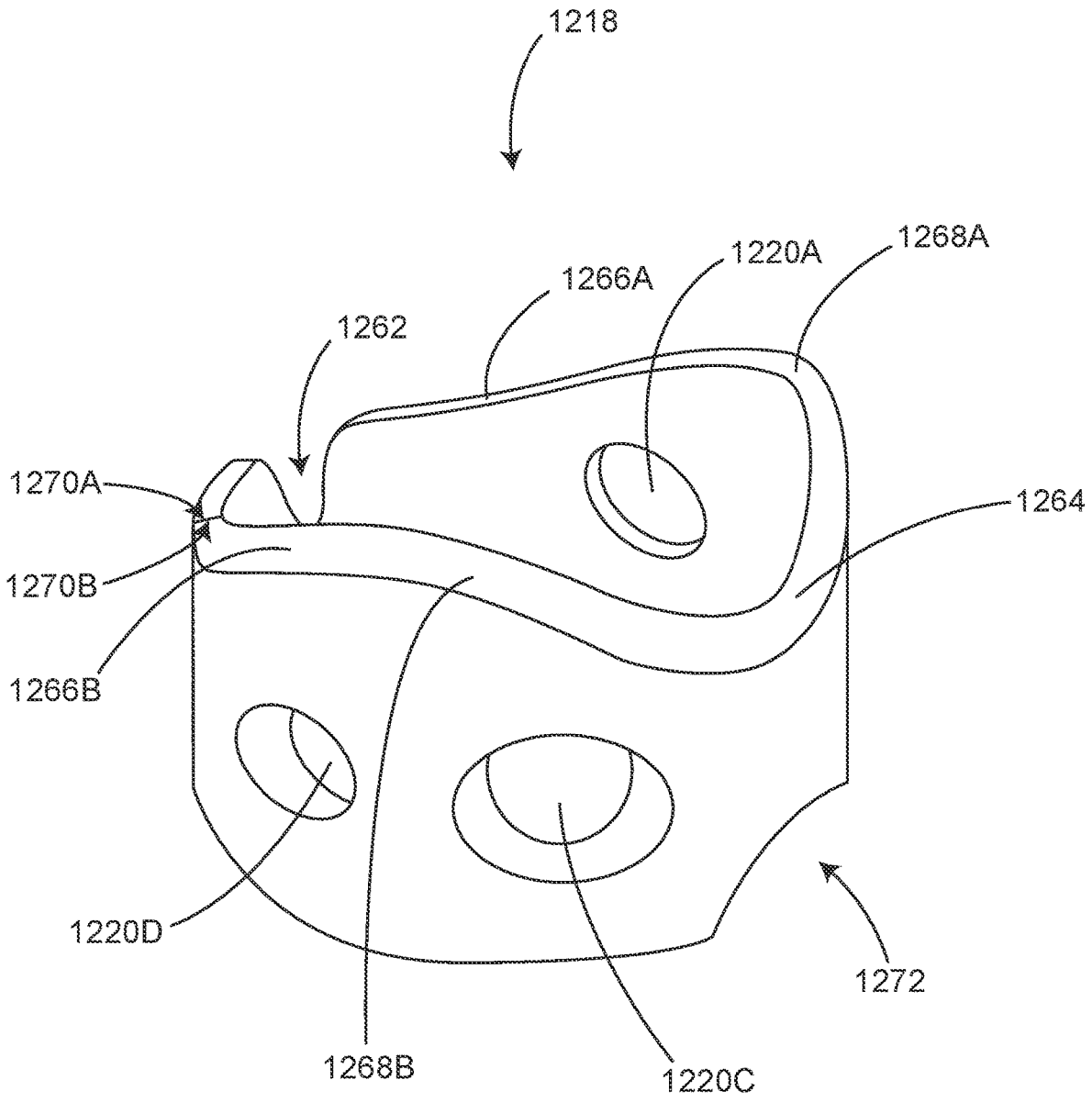
FIG. 14 shows a perspective view of the face mask of FIG. 12 in an assembled state, in accordance with at least one example.

FIGS. 12, 13 show two side views of a facemask 1218 in an unassembled and assembled state, respectively. FIG. 14 shows a perspective view of the facemask 1218 in the assembled state of FIG. 13. The facemask 1218 can be used with any shield 2, such as the shield of FIG. 1. As shown in FIGS. 12 and 13, the method of constructing the foam facemask 1218 from a strip of foam material with the ends joined together may be advantageous because the strip of foam material can be easily and inexpensively die cut or cut by other cutting processes, without requiring expensive tooling and molds. FIG. 12 shows an example of the foam facemask 1218 after it has been die cut. FIGS. 13 and 14 shows the foam facemask 1218 of FIG. 12, after the two ends 1270A,B have been glued together but before it is attached to the shield 2. Many adhesives are suitable for gluing the two ends of the foam facemask together. In some examples a contact adhesive may be preferable.

As shown in FIGS. 13 and 14, in some examples, the ends 1270A, B of the strip of foam facemask material 1272 can be glued together in the area of the facemask 1218 configured to abut a wearer's cheekbones (e.g., see cheeks in FIG. 1 and see cheekbone interface 1266A,B in FIGS. 13 and 14). This allows the glued joint to avoid the weakened areas created by the chin indentation 1264 and nose 1262 indentation and the ventilation openings 1220A-D, helping to maintain the structural integrity of the facemask 1218.

In some examples, the method of constructing the foam facemask 1218 from a strip of foam material 1272 with the ends 1270A,B joined together may also be advantageous because the substantially tubular foam facemask 1218 may be more compressible when placed against the face than a similar shaped structure made of molded foam, molded rubber or other molded elastomers such as silicone. Superior compressibility can result in a gentler conformability to the user's facial topography.

Returning to FIGS. 2 and 4, in some examples, as shown in FIG. 2, which depicts the device in an unworn state, the facemask 18 attachment to the face shield 2 may be substantially circular which naturally forms the facemask 18 into a substantially circular tube. However, it should be noted that other tubular cross-sectional shapes are anticipated including but not limited to oval, triangular, truncated triangular, rectangular, polygonal, or irregular. In some examples as shown in FIG. 2, the facemask 18 can include a substantially circular tube until the face shield 2 is curved around the user's face. In contrast as shown in the worn state of FIG. 4, bending the face shield 2 around the face (not shown) causes the open end of the tubular shaped facemask 18 to distort into an oval shape with the elongate axis being vertical or substantially vertical (e.g., vertical with respect to a user wearing a mask with the user standing in an upright position). This oval shape may be preferable for making an optimal seal against the user's face. In some examples, it can be beneficial for the circular-shaped facemask 18 to elongate into an oval or other shape where the face mask 18 contacts the face so that the sides of the circular mask can make good contact with the patient's cheeks and mouth, allowing air to leak through the gap. Alternatively, if the facemask 18 were attached to the face shield 2 in a vertically oriented oval shape, the inward distortion naturally caused by the bending of the face shield 2 around the face, would result the sidewalls of the side of the facemask 18 contacting the face to nearly touch together, also preventing a seal against the face. Therefore, in some examples, the inventors have discovered that it can be advantageous to attach the facemask 18 to the face shield 2 in a substantially round configuration and rely on the bending of the face shield 2 around the user's face to morph the sealing edge of the facemask into the preferred substantially oval shape for sealing against the face.

In some examples, as shown in FIG. 4, a facemask 18 can optimize contact with the user's cheeks by distorting the sides of the facemask 18 contacting the face 6 inward against the cheeks of the user. The cheeks are frequently the most difficult place to make any facemask seal. This dynamic conformability of the facemask 18 against the cheeks, is in response to the face shield 2 bending around the face 6 due to the user attachment 14 that are attached to the shield 2, being tightened. The flexible foam facemask 18 is capable of responding to the bending of the shield 2 by distorting into a substantially oval shape with the sidewalls urged against the cheeks. The shield 2 and facemask 18 work together to optimize the seal against the face 6.

In some examples, as shown in FIG. 4, a method of optimizing contact between a facemask 18 and the user's cheeks by distorting the sides of the facemask 18 contacting the face 6 (FIG. 1) inward against the cheeks is shown. This method of dynamic conformability of the facemask 18 against the cheeks is in response to the face shield 2 bending around the face 6 due to the user attachment 14 that are attached to the shield, being tightened. Attaching the user attachment 14 to the face shield 2 and not the face mask 18 may be advantageous for creating dynamic conformability. In contrast, conventional facemasks attach directly to the tie strings or elastic bands that anchor the facemask to the user's head.

Many polymeric and rubber foams are suitable for making the facemask 18, including but not limited to: polyurethane, polyethylene, PVC, neoprene, viscoelastic foams. The foam material should be soft enough to conform comfortably to the face and yet stiff enough to form a tube that can be compressed against the face without collapsing. In some examples, the edge of the facemask 18 touching the face may be sculpted to improve the fit, for example the upper edge of the facemask 18 touching the face may include a cutout 62 to accommodate the user's nose. In some examples it may be advantageous to make the facemask 18 out of a closed-cell foam material so that it does not soak up moisture from the user's exhaled breath or from cleaning fluids. Closed-cell foams are also much more cleanable compared to open-cell foams. Closed-cell foams may be less likely to get contaminated or smelly because they can be less susceptible to allowing growth of mouth flora and other contaminants. Since it is anticipated that one or more portions of the face shield 2 and respirator 4 of this disclosure can be reusable, perhaps even for weeks or months, clean-ability can be an important feature. Alternatively, in some examples the tubular foam facemask 18 and face shield 2 may preferably be a single use disposable in which case the facemask 18 may be made of open-cell foams such as polyurethane or polyethylene.

FIG. 5 shows a perspective view of a portion of the device 1. Note the facemask 18 of FIGS. 5-8 depicts a slightly different ventilation opening 20 pattern compared to the ventilation opening 20 pattern in the facemask 18 of FIGS. 1-4. In some examples, the walls of the tubular foam of facemask 18 may be in a range between 0.25 inch and 0.75 inch thick. In a possibly preferred example, the walls of the tubular foam of facemask 18 may be about 0.375 inch thick to provide tight sufficient rigidity and compliance. In some examples, the tubular foam of facemask 18 may be in a range between 1.0 inch and 3.0 inches deep (in a direction fore-aft with respect to a face of a user, shown as D1 in FIG. 5, or the anterior-posterior A-P directions shown in FIG. 1). In some examples, the tubular foam of facemask 18 may preferably be 2.0 inches deep (D1, FIG. 5). In a possibly preferred example, the internal span or diameter (S1, FIG. 2) of the tubular foam facemask 18 may be in a range between 2.0 inches and 3.5 inches. Tubular may include circular tube construction, but tubular may also include other shapes of tubes, including but not limited to, oval, tear drop, triangular, polygonal and irregular tubular constructions forming an outer perimeter that may be circumferential, but need not be circumferential.

One end of the tubular foam facemask 18 can be bonded to the back side 10 of the face shield 2. The other open end of the tubular facemask 18 can open rearward to engage the user's face, surrounding the nose and mouth against the back side 10 (rear surface) of the facemask 18. In some examples, the tubular foam facemask 18 is bonded to the back side 10 of the face shield 2 at a forward portion 42 (FIG. 3) such as a forward surface of the facemask 18 using suitable adhesives, solvents or pressure sensitive adhesives (PSA). In some examples, contact cement may be preferable. Other bonding and attachment means are anticipated, including welding such as ultrasonic or radio-frequency welding; or fasteners.

In some examples, the rubber-like foam of facemask 18 creates a gasket-like seal against the face 6 of the user. In contrast to the prior art standard "N95" facemask used by healthcare and industrial workers which is made of thermoformed, non-woven fabric with no gasket, the facemask 18 of this disclosure requires much less force to create an excellent seal against the face. "N95" facemasks notoriously try to compensate for the lack of a gasket by requiring tight elastic bands to hold the mask tightly against the face. With prolonged use these tight elastic bands frequently result in facial bruising and even pressure ulcerations. The gasket-like seal of the facemask 18 of this disclosure results in being more comfortable for the user, especially with extended use.

In some examples, the gasket-like seal created by the rubber-like foam of facemask 18 is more comfortable than the gasket-like seals created by other prior art respirators. Some conventional respirators that have gasket-like seals include a ring of rubber or silicone at the edge of a hard, stiff, molded plastic shell. Some anesthesia masks substitute an inflatable "doughnut" made of plastic film for the ring of rubber or silicone to make the seal against the face. The gaskets of prior art masks have limited ability to adapt to the contours of the face because the gaskets are relatively thin and attached to molded plastic shell. In contrast, some examples the facemask 18 of this disclosure can have 2 inches of compressible foam material that can significantly deform to accommodate the topography of the face and is therefore much more comfortable.

In some examples, a cut edge of the closed-cell foam of the facemask 18 of this disclosure, creates a textured surface that can "breathe" and thus dissipate moisture from the skin below. The "breathability" of the foam/face interface of the gasket of this disclosure results in a much more comfortable fit compared to prior art facemask gaskets, especially during extended use.

In some examples, the facemask 18 of this disclosure produces a more comfortable, more conformable and reliable seal against the user's face than other respirators due to any of the following features: 1) The rubber-like closed-cell foam material can create a gasket-like seal against the face that is much more comfortable and effective than existing gasket-less standard N95 masks. 2) The facemask 18 may be sized to fit precisely between the bridge of the nose and the chin bone in the vertical plane. In contrast to cup-like N95 masks that engulf the face and extend under the jaw. 3) The foam/face interface of the facemask 18 of this disclosure may be sculpted to include one or more of: indentations to accommodate the bridge of the nose, the chin and the cheekbones and protrusions in the areas of the cheeks to improve the seal against the cheeks. This is in contrast to both N95 masks and other gasketed masks. 4) The closed-cell foam material of the facemask 18 is easily compressible, adding to the conformability to the topography of the face. This is in contrast to both N95 masks and other gasketed masks. 5) The substantially circular flexible foam facemask 18 is capable of responding to the bending (e.g., elastically deforming) of the face shield 2 by distorting into a substantially oval shape, with the sidewalls of the facemask 18 urged against the cheeks. This dynamic conformability of the facemask 18 against the cheeks is in response to the face shield 2 bending around the face 6 improves the seal against the cheeks. No other facemasks have this dynamically conformable seal capability.

It is known that one of the most common ways that communicable respiratory viruses are transmitted is by hand-to-face touching. Contaminated hands touching the face, especially the mouth, nose or eyes can transfer viruses directly to the vulnerable orifices that allow entry into the body. Uncomfortable, annoying or painful facemasks inadvertently increase the risk of this kind of viral transmission because the user frequently readjusts the mask on their face. In the process of readjusting, the user can contaminate the mask, the mask can contaminate their hands and either the mask or their hands can contaminate their face. In contrast, if the facemask 18 of this disclosure needs readjusting, readjustment may be accomplished by grasping the shield and moving the mask without ever touching the mask or approaching your face with your hands. Readjusting the facemask on the face also negates the benefit of "fit testing." If the mask is readjusted 100 times over an 8 hour shift, statistically, 80 of those readjusted locations are most likely not the preferred location identified by the fit test. By definition, readjustment automatically negates the fit test.

In some examples, the facemask 18 may be made by a molding process rather than a die cutting process. The molded facemasks 18 may be made of the various closed-cell foam materials that have described herein for examples that can be formed by die cutting. In some examples, the molded facemasks 18 may be made of various moldable rubber, silicone or plastic materials.

In some examples as shown in FIG. 1, the user attachment 14 can include one or more straps, strings or elastic bands 14. The user attachment 14 can attach near the lateral edges of the face shield 2 and can be tied or connected by adjustor or other adjustment means behind the user's 8 neck or head. In FIG. 1, the user attachment 14 is shown as tie straps, however, in some examples the user attachment 14 can extend continuously from a first lateral portion 14A to a second lateral portion 14B (FIG. 2) of the face shield 2. Such a continuous user attachment 14 may include an adjustor to adjust the tension to allow a user to easily adjust the tension. When the user attachment 14 is tightened, the face shield 2 and tubular foam facemask 18 are pulled toward the user's 8 face, making a substantially airtight seal with the face 6 surrounding the nose and mouth. When the user attachment 14, such as the straps or strings are tightened, the face shield 2 is advantageously bent into a curved shape around the face 6 and facemask 18, adding to the protection afforded by the face shield 2 over conventional devices. The curved shape of the face shield 2 when tightened by user attachment 14 against the face 6, naturally tries to rebound into its normal planer state, creating a tensioning mechanism against the pull of the user attachment 14 that introduces a spring-like effect to the otherwise non-stretching straps or strings 14. The spring-like effect makes the face shield 2 with respirator 4 much more comfortable for the user compared to simple non-stretching strings or straps tied behind the user's head or neck as seen in conventional masks. In some examples, the user attachment can be elastic, resiliently deformable, or substantially resiliently deformable.

In some examples as shown in FIG. 1, the user attachment 14 can include one or more straps, strings or elastic bands may be tied or secured with slip beads or neck cord locks behind the user's neck rather than behind their head as with conventional masks. This is possible because the facemask 18 of this disclosure can seal against the user's face 6 much like the facemasks used for medical ventilation in contrast to conventional filter facemasks that fit grossly over the nose and mouth without making an air-tight ring seal around their perimeters. Conventional face masks also need to be anchored with an upward force to the back of the head in order to prevent sliding down the face, because they do not positively engage the nose. Since the face is basically a vertical plane and the neck is directly opposite the nose and mouth, anchoring to the neck projects the force applied to the straps or strings, perpendicularly to the face and is thus more efficient at securing a seal than a tangential force projected toward the back of the head. However, if the user's nose is not positively engaged by the mask, anchoring to the neck will allow a conventional mask to slip down. The mask 18 of this disclosure positively engages the nose to prevent the mask 18 from sliding down and therefore the angle of pull on the ties can be perpendicular as opposed to upward. As such, the device 1 can be configured such that user attachments 14 are configured to hold the device 1 in place with the user attachments 14 secured below the user's ears, and in some examples, the device can be configured to stay in place even when the user attachment 14 are only attached below the user's ears.

As shown in FIGS. 2 and 3, the facemask 18 can include one or more ventilation openings 20, such as a plurality of ventilation openings 20 (e.g., apertures, holes) that extend from the inner surface 22 of the facemask 18, through to the outer surface 24 of the facemask 18. These ventilation openings 20 can allow the ventilation air to pass from the inner chamber 26 of the facemask 18, outward during exhalation and inward during inhalation. The ventilation openings 20 may be of any size, shape or pattern. In some examples the ventilation openings 20 may be round and 0.25 inch to 1.00 inch in diameter. In some examples the ventilation openings 20 may be located only on the lower ⅔ of the circumference of the facemask 18, in order to direct ventilation, especially exhalation, downward or laterally—away from the field of vision. Exhaled humid air that reaches the field of vision can fog the user's glasses and the face shield 2, obstructing vision. Therefore, in some examples, the upper ⅓ to ½ of the circumference or perimeter of the facemask 18—the part of the circumference or perimeter facing the eyes, may advantageously not have any ventilation openings 20. Note, the facemask 18 need not be exactly circular in a cross-section perpendicular to the anterior-proximal direction (e.g., a long a longitudinal axis of the facemask 18).

Figure 9:
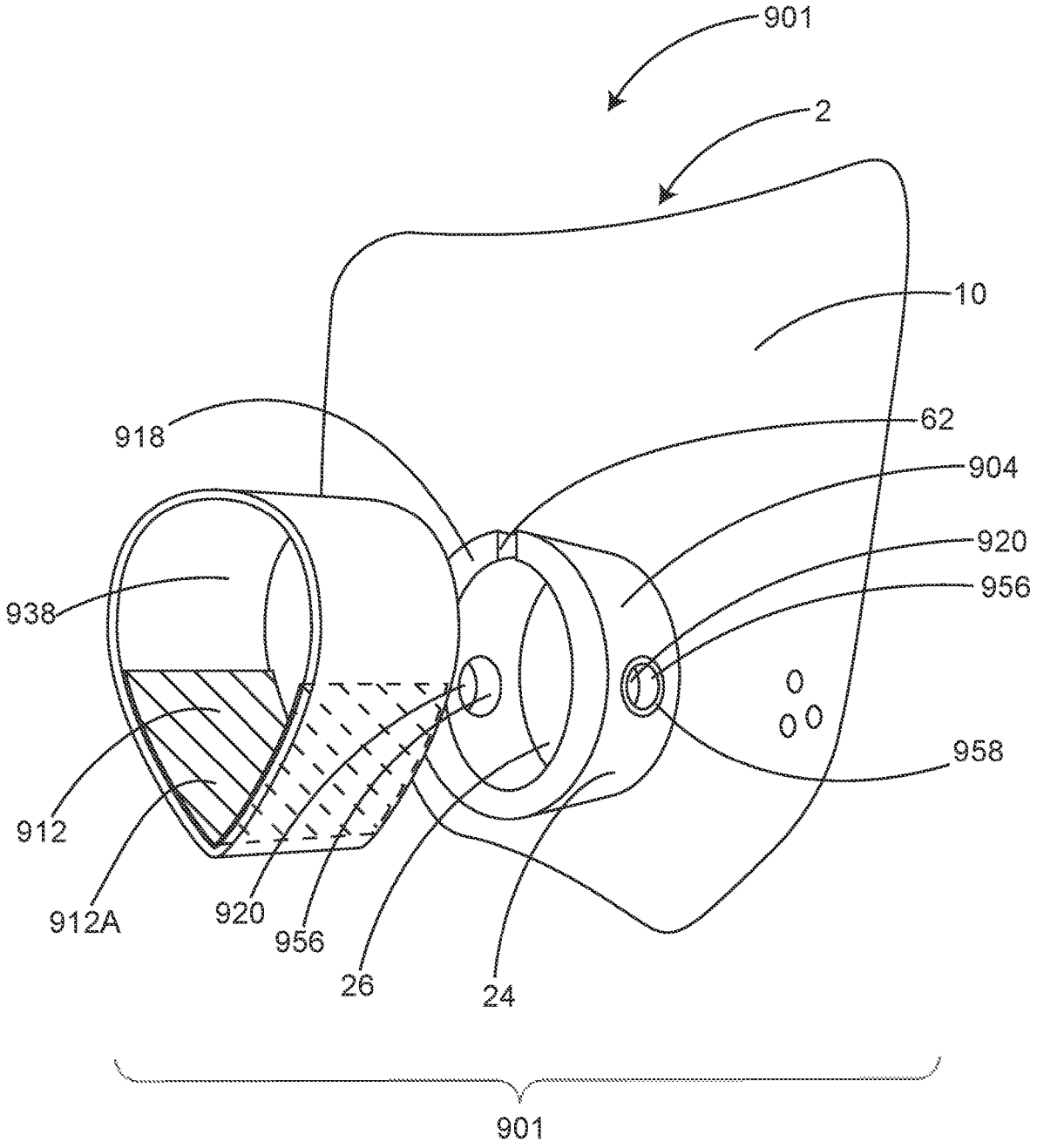
FIG. 9 shows a perspective view of a second example of a device including a protective face shield and a respirator with a filter unattached, in accordance with at least one example.

FIG. 9 shows a perspective view of a second example of a protective device 901 including face shield 2 with a respirator 904 including a filter 912 unattached in an explode view. In some examples, cutting ventilation openings 920 into the sidewalls of facemask 918, can weaken the sidewalls to the point where the sidewalls may collapse if the user attachment 14 (FIG. 1) are over-tightened. To prevent collapse, as shown in FIG. 9, one or more bushings 956 that are sized to substantially fit the ventilation openings 920 may be inserted into one or more of the ventilations openings 920 in order to prevent collapse. The bushings 956 can be rigid compared to the facemask 918 and can be formed of plastic, rubber, metal, or any other suitable material. In some examples, the bushings 956 may be slightly larger than the ventilation openings 920 in order to produce a snug fit into the foam of the facemask 918. In some examples, the bushings 956 may include a flange 958 on one side that prevents the bushing 956 from passing through the ventilation opening 920. In some examples, the flanges 958 on the bushings 956 may positioned on the outside of the facemask 918 in order to prevent the bushing 956 from inadvertently passing through the ventilation opening 920 into the inner chamber 926 of the facemask 918. The filters 912 and prefilter of non-filtering fabric 938 (e.g., relatively less filtering fabric compared to filter 912) stretched over the top of the bushing 956 can prevent the bushing 956 from inadvertently falling out of the ventilation opening 920. In some examples, the flanges 958 on the bushings 956 may positioned on the inside of the facemask 918 in order to prevent the bushing 956 from inadvertently passing through the ventilation opening 920 and falling out on the outside of the facemask 918. In some examples, the flanges 958 on the bushings 956 may positioned on both the inside and outside of the facemask 918 in order to prevent the bushing 956 from inadvertently passing through the ventilation opening 920 and falling out on either side of the facemask 918.

In some examples, the flanges 958 on the bushings 956 may positioned on the inside of the facemask 918 and the inside of the bushing 956 of may be substantially round and equal in size to a round hole or opening cut into the facemask 918. For example, there may be a 1 inch. diameter hole cut into the facemask 918 and the inside of the bushing 956 may be round and substantially 1 inch. in diameter. In some examples, the bushings 956 may transition into a substantially square shape on their outside. In this example, the substantially square shape forces the stretchable foam round 1 inch. hole into a substantially 1 inch. square hole, on the outside surface of the facemask 918. A 1 inch. diameter round hole can engage with 0.785 sq. inch. of overlaying filter material. A 1 inch. square hole can engage with 1.0 sq. in. of overlaying filter material. Therefore, by transitioning from a round to a square hole, 27% more filter material is included in the breathing area and that predictably makes breathing through the filter 27% easier.

In some examples, the flanges 958 on the bushings 956 may positioned on the inside of the facemask 918 and the inside of the bushing 956 of may be substantially square and equal in size to a square hole cut into the facemask 918. For example, there may be a 1 inch square hole cut into the facemask 918 and the inside of the bushing 956 may be square and substantially 1 inch square. In some examples, the bushings 956 may transition into a substantially rectangular shape on their outside. In this example, the substantially rectangular shape forces the stretchable foam square 1 inch hole into a substantially 1 inch×1.5 inch rectangular hole, on the outside surface of the facemask 918. A 1 inch×1.5 inch rectangular hole can engage with 1.5 sq. inch of overlaying filter material. A 1 inch square hole can engage with 1.0 sq. in. of overlaying filter material. Therefore, by transitioning from a square to a rectangular hole, 50% more filter material is included in the breathing area and that predictably makes breathing through the filter 33% easier. Ventilation openings 920 of other sizes and shapes are anticipated. Bushings 956 of other sizes and shapes are also anticipated.

The tubular foam facemasks described herein, such as facemask 18 of FIG. 1, are easy and inexpensive to make, comfortable for the user to wear for prolonged periods, provides an excellent air seal against the user's face (6, FIG. 1), and provides separation and a secure mounting platform for the face shield 2 to be suspended in front of the user's face, without touching the face. The volume of air inside the inner chamber 26 of facemask 18 is relatively small compared to some respirators. The smaller volume of air in the inner chamber 26 is advantageous for minimizing the amount of air that is being "re-breathed." In other words, minimizing the amount of inhaled air that has a higher $CO_2$ and lower $O_2$ content, left over from the last exhalation. In some examples, this protective face shield 2 and facemask 18 are easily cleanable and thus reusable. In some examples, this protective face shield 2 and facemask 18 are meant to be disposable rather than cleaned.

In some examples as shown in FIG. 3, an expiratory valve 36 may pass through an opening, recess or aperture in the wall of the facemask 18, or the expiratory valve 36 may be located between the wall of the facemask 18 and the face shield 2, allowing exhaled air to easily escape from the inner chamber 26 (FIG. 2) of facemask 18. An expiratory valve 36 minimizes humidity and moisture buildup in the facemask 18 and allows easier exhalation. The expiratory valve 36 may be a Heimlich valve that consists of two opposing pieces of flat plastic or rubber film. The expiratory valve 36 may be a duckbill valve that consists of two molded pieces of plastic or rubber that oppose each other much like a Heimlich valve. The expiratory valve 36 may be a flap valve that consists of a plastic or rubber flap that covers an opening or hole in the facemask 18 wall. In each of these examples of one-way valves, air is allowed to easily pass in one direction but is prevented from passing in the other direction. Any suitable valve, including other one-way valves can be used.

In some examples as shown in FIGS. 2 and 5, a filter 12 can include a ribbon-like strip including at least a portion of air filter media or filter material 12 that is formed into a tubular shape that is sized to wrap snuggly around the tubular foam material of the facemask 18. The filter material 12 can have a width W1. The tubular filter media 12 can cover the plurality of holes 20 in the facemask 18 and thus filters the air entering and exiting through the holes 20 in the facemask 18. The facemask 18 can have a depth D1. The tubular shape of the facemask 18 and the tubular shape of the filter media 12 allow for very simple and inexpensive manufacturing, provides a positive coupling that forces all air flow to go through the filter media 12 and eliminates the need for additional frames or mounting fixtures. In some examples, the width W1 of the ribbon of filter media 12 approximates the depth D1 of the respirator 4 facemask 18. In some examples, the width W1 can be plus or minus 25% of the depth D1. In a possibly more preferred example, the width W1 can be plus or minus 10% of the depth D1. The depth D1 can allow the filter media 12 to completely cover holes 20. If plastic frames or mounting fixtures were required to seat the filter media 12, it may be difficult to comfortably mate the facemask 18 with the user's face. The inventors have solved this problem through a circumferential design for the filter media 12 that is arguably the simplest and least expensive, yet secure way to attach a high efficiency filter to a ventilating facemask. In some examples the high efficiency tubular filter 12 is easily replaced and is disposable.

In some examples, the tubular filter media 12 is wider W1 than the depth D1 of the tubular foam material of the facemask 18 and extends beyond the face-engaging end of the facemask 18 material. The extension of tubular filter media 12 provides a secondary seal with the user's face (6, FIG. 1), thus allowing the facemask 18 to be applied to the face with much less force than traditional facemasks. Any air leaks between the facemask 18 and the user's face can still traverse through the filter media 12 that is effectively covering the leaking area. Leaks with all other facemasks create a direct route for unfiltered potentially contaminated air to either enter or exit the mask. Thicker HEPA filter material, for example Techno Stat® 200-400 grams per square meter (GSM) is soft and fluffy. This type of HEPA filter material may be preferable because it is comfortable contacting the face. The excessive filtration capacity of this heavier filter material also allows longer use times before filter exhaustion.

In some examples, as shown in FIG. 2, the filter 12 can include the ribbon-like strip having at least a portion of air filter media 12 formed into a tubular shape by sewing, gluing or otherwise bonding the two ends of the ribbon-like strip together, or one or more strips together, such as the two connections of end portions of two strips shown in FIG. 2. Any number of strips can be provided and can have irregular shapes to conform to the shape of the facemask 18. The resulting filter 12 is inexpensive yet highly efficient and seats snuggly around the tubular compressible foam facemask 18 without requiring the stiff mounting frames necessary for most removable filters.

In some examples, as shown in the device 901 of FIG. 9, a filter 912 can include one or more strips of air filter media 912A and may be comprised of two or more different materials. For example, if filter media 912A is either expensive or in short supply, it may be advantageous to use the filter media 912A only for the lower ½ to ⅔ of the circumference of the filter 912 of the facemask 918, covering the part that has the ventilation opening 920. In this case, the upper ½ to ⅓ of the circumference of the facemask 918, the part that has no ventilation opening 920 may be covered with any fabric. The tubular shaped filter 912 can be partially made of filter media 912A and partially made of non-filter fabric that may be sewn or glued together. Alternately, if a tighter fit was desired between the filter media 912A and the facemask 918, the non-filter section (e.g., 938) may be an elastic fabric. Alternately, if less glare near the user's eyes was desirable, the white filter media on the top side of the facemask 918 may preferentially be replaced with a dark color fabric.

As shown in FIG. 9, a ribbon-like strip of non-filtering fabric 938 (e.g., relatively lower filtering fabric compared to filter 912A) may be formed into a tubular shape by sewing, gluing or otherwise bonding the two ends (e.g., end portions) of the ribbon-like strip together. The tubular shape is sized to fit snuggly around the facemask 918. In some examples, the non-filtering fabric 938 does not need to form a tube independently of the filter material 912A, but instead can form a tube together with the filter material 912A. In some examples, it may be advantageous to use a stretchy fabric such a polyester fleece material. Other fabrics and foams are anticipated. The loosely woven fleece material may not be effective filter, depending on the application, but readily allows air to pass through. A ribbon-like strip of air filter media 912A of any length can be attached to the inner surface of the tubular ribbon-like strip of non-filtering fabric 938 and the user is directed to orient the air filter media 912A over the ventilation opening 920 when installing the filter. The air filter media 912 can be snuggly held in place over the ventilation opening 920 (e.g., a region of the ventilation holes) by the stretchy non-filtering fabric 938 (e.g., relatively less-filtering fabric compared to the air filter media 912). This is in contrast to the relative non-stretchy properties of nonwoven filter materials. In comparison, a ribbon-like strip of air filter media 912 (e.g., FIG. 2) formed into a tubular shape may not appreciably stretch and therefore may be more difficult to load onto the facemask 918 and may still function well but not fit as snuggly.

In some examples, the ribbon of stretchy fabric 938 such a polyester fleece material stretched around and anchoring the ribbon of filter media 912 over the ventilation opening 920 of facemask 918, may serve multiple additional purposes. In some examples this ribbon of stretchy fabric 938 may serve as a pre-filter. A stretchy fabric 938 such as fleece material, for example, may be a relatively poor filter of small airborne particles compared to the filter media 912, however, it can still filter larger droplets and dust bunnies, preventing them from contaminating or compromising the high efficiency filter 912 located within and protected by the stretchy fabric 938. The fact that the pre-filter 938 may not capture viruses may be advantageous. It is well known that sucking virus-contaminated air through a filter can lead to the deposition of many viruses on the surface of the filter material. Subsequent touching of the filter surface can transfer those viruses to the hands of the user, hands which may then touch and contaminate the user's face. With the instant invention of this disclosure, airborne viruses may advantageously pass through the pre-filter 938 before being captured by the high efficiency filter media 912. The outer layer of pre-filter material 938 remains relatively uncontaminated to the touch, preventing the user from self-contamination with viruses that could otherwise be caught in the filter 12 of the respirator 4.

In some examples, the use of a ribbon of stretchy fabric 938 such a polyester fleece material, stretched around and anchoring the ribbon of filter media 12 over the ventilation holes 20 of facemask 18, may also be advantageous from the manufacturing point of view. For example, in one example of the facemask 18 of this disclosure can include two short 4 inch. ribbons of high efficiency filter media 12 to cover the ventilation holes 20 on each side of facemask 18, and the total circumference of facemask 18 can be about 12 in. Two 4 inch. by 48 inch strips of filter media 12 may be sewn longitudinally to a 12 in. by 48 in. piece of stretchy fabric 938 such a polyester fleece material. The stretchy fabric 938 can then folded down the middle with the strips of filter media 12 positioned between the folded stretchy fabric 938. The opposing edges of the stretchy fabric 938 can then be sewn together creating a tube-like structure that is approximately 12 inches. in circumference and 48 inches. long with two strips of 4 inch. high efficiency filter media 12 running from end to end within the tube. In some examples, the sausage-like tube can be cut cross-wise into 1.5-2.5 inch slices, each of which is a filter sized to surround the facemask 18 of this disclosure. The cross cuts may be accomplished with any fabric cutting mechanism including but not limited to scissors, shears, fabric saws and die cutters. In some examples, die cutting may be preferred because it can cleanly cut the entire 48 inch tube into twenty-four 2 inch. wide filter 12 slices, in a single press-cut with a die-cutting press. This is a very efficient method of making the circumferential filters of this disclosure. In some examples both the filter material 912 and the non-filtering fabric 938 can extend mostly or entirely around the facemask 918.

In some examples as shown in FIG. 9, the ribbon-like strip of non-filtering fabric 938 may advantageously be a colored fabric. This is in contrast to the air filter material 912A that is generally available only in white. Colored materials may be advantageous for marketing and branding but also darker colors may produce less glare than white materials, when located close to the eyes.

In some examples, the ribbon-like strip of air filter media (e.g., 12, 912A may be formed into a tubular shape by wrapping the strip of filter media around the facemask 18 and securing each end to the facemask 18. The strip of filter media 12 may be secured to the facemask 18 with adhesive, hook and loop fastener or another mechanical securement means.

Returning to the device 1 of FIG. 2, in some examples, it may be desirable to close the expiratory valve 36, such as a Heimlich exhalation valve. For example, if the face shield 2 and respirator 4 of this disclosure were to be used near the sterile field during surgery, it may be desirable to prevent unfiltered exhaust air from blowing directly downward into the sterile surgical field. In this case, the expiratory valve 36 may be folded at its attachment to the facemask 18, and the tail of the expiratory valve 36 may be tucked under the filter 12. The folding of the expiratory valve 36 may occlude all airflow through the valve 36 but if some airflow still passes through the valve 36, the air will be filtered by the filter 12 before exhausting into the room. The simple modification of tucking the exhalation valve 36 under the filter 12 can make the exhaust air safe for use next to the sterile surgical field.

In some examples, a disk shaped or a tubular shaped or cup shaped insert of filter material 12 may be placed inside the inner chamber 26 of facemask 18 of this disclosure. The facemask 18 can still provide the physical structure and support the face shield 2 but the filtering then occurs inside the facemask 18 rather than outside the facemask 18.

Locating the respirator 4 of this face shield/respirator combination behind the face shield 2, physically protects the respirator 4 from airborne droplets and spray, vastly reducing the airborne contaminates encountered by the filter media 12. The filter media 12 protected by face shield 2 is much less likely to become contaminated with microbes such as COVID-19 viruses and is nearly impossible to contaminate with gross fluids that could "flash through" the filter media 12. Thus, the filter media 12 does not need to be discarded between each patient encounter. Such a design may make it possible for the filter media to be changed less frequently than conventional devices. For example, once per day, or once per shift may generally be adequate. In contrast, conventional filtered facemasks have their filters either directly facing the patient or sideways to the patient, but in each case are directly exposed to the patient and airborne droplets and airborne fluids from the patient. As a result, conventional filtered face masks generally must be discarded between patient encounters.

Wrapping the facemask 18 in filter media 12 (FIG. 2) or a ribbon-like strip of non-filtering fabric 938 (FIG. 9), protects the facemask 18 from airborne contamination. Therefore, the facemask 18 portion of the respirator 4 does not require cleaning between patient encounters, making the daily use of this protective device very efficient. The tubular facemask 18 has an added safety feature in that the inspired air enters from the protected space formed between the face shield 2 and the face of the user 8.

Figure 15:
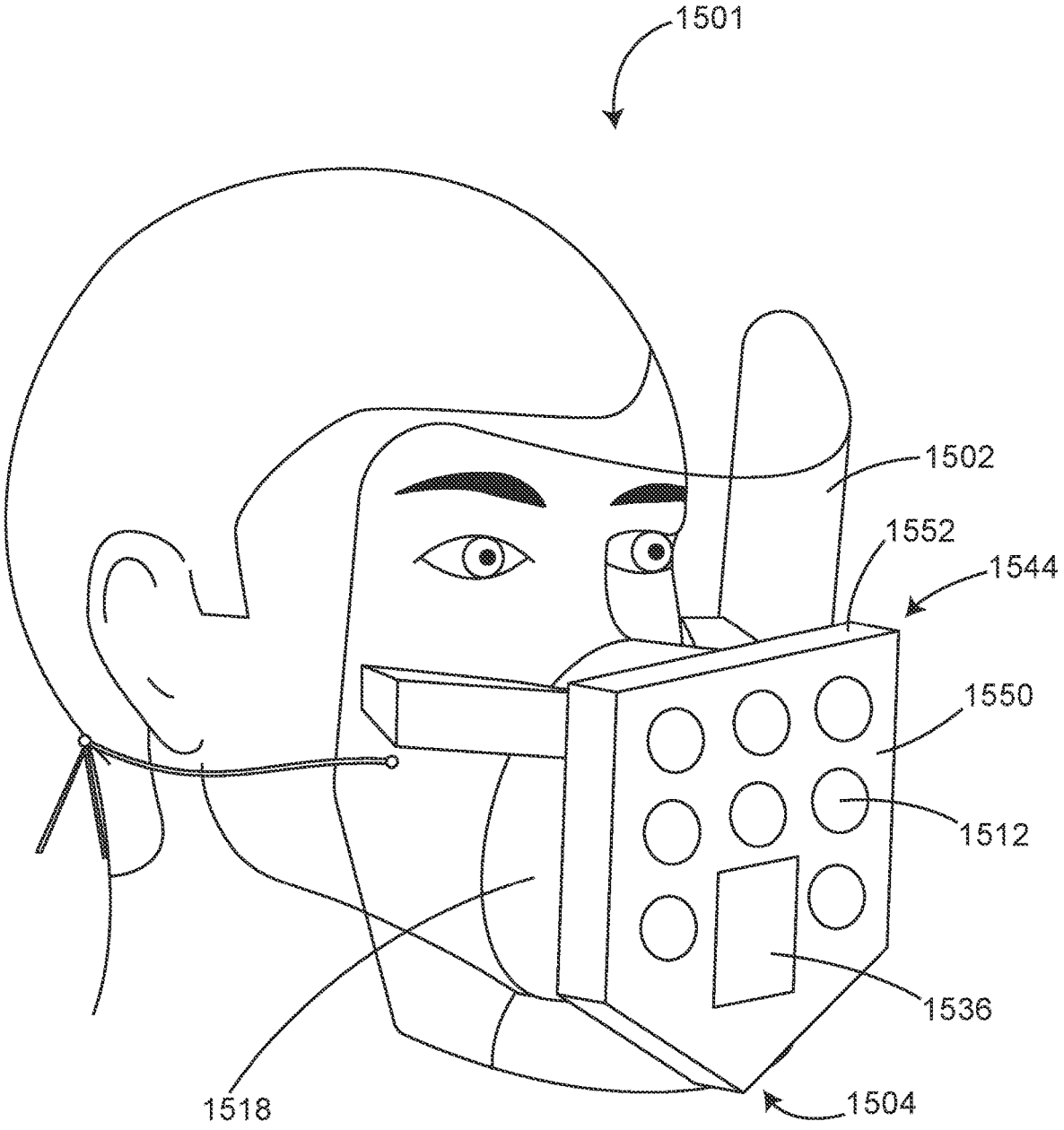
FIG. 15 shows a perspective view of a fifth example of a device including a protective face shield and a respirator, in accordance with at least one example.
Figure 16:
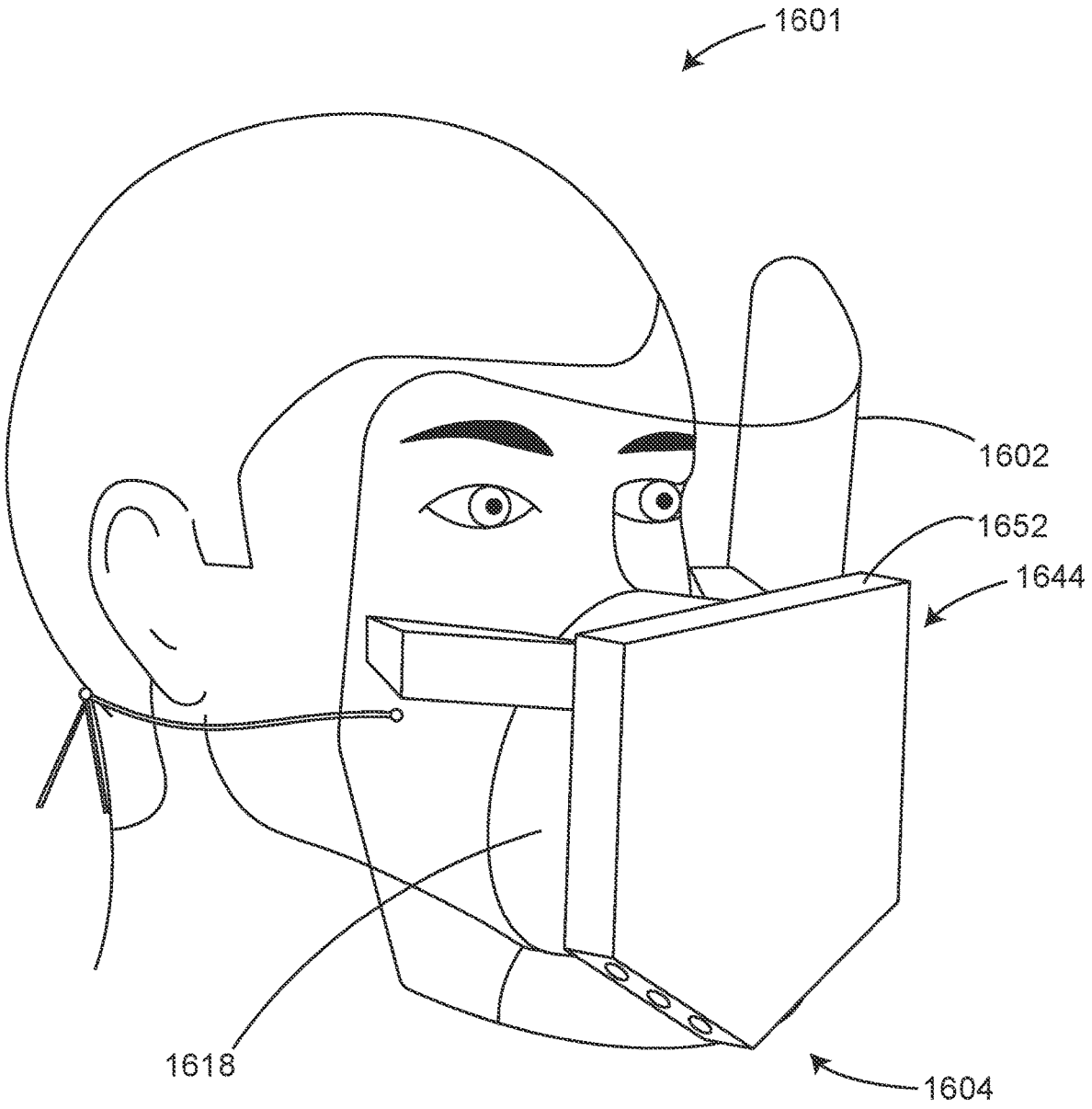
FIG. 16 shows a perspective view of a sixth example of a device including a protective face shield with a respirator, in accordance with at least one example.

FIG. 15 shows a perspective view of a fifth example of a protective face shield 1502 with respirator 1504. FIG. 16 shows a perspective view of a sixth example of a protective face shield 1602 with respirator 1604 having similarities to FIG. 15. FIGS. 15 and 16 are described together for the sake of brevity.

In some examples as shown in FIGS. 15 and 16, the devices 1501, 1601 can include a respirator 1504, 1604 having a filter canister 1544, 1644 that may be mounted on the front side of the shield 1502, 1602 and can include a cover 1552, 1652 forward of a facemask 1518, 1618. The facemasks 1518, 1618 can be the same or similar to facemask 18, or can be different, such as a facemask 1718 with no vent openings as shown in FIGS. 17 and 18.

Figure 17:
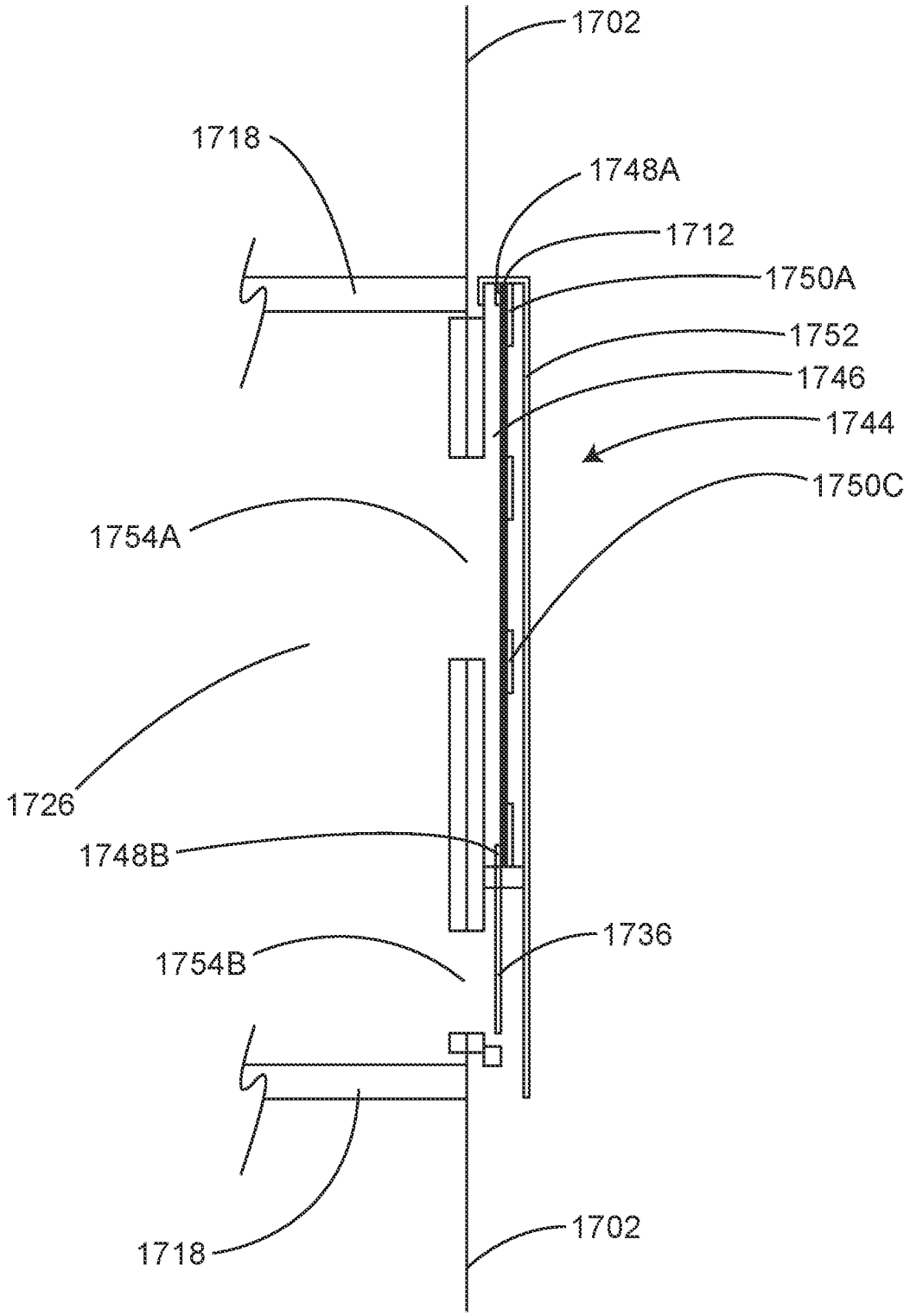
FIG. 17 shows a cross-sectional view of a protective face shield, and including a respirator cross-section taken along line 17-17 in FIG. 18, in accordance with at least one example.
Figure 18:
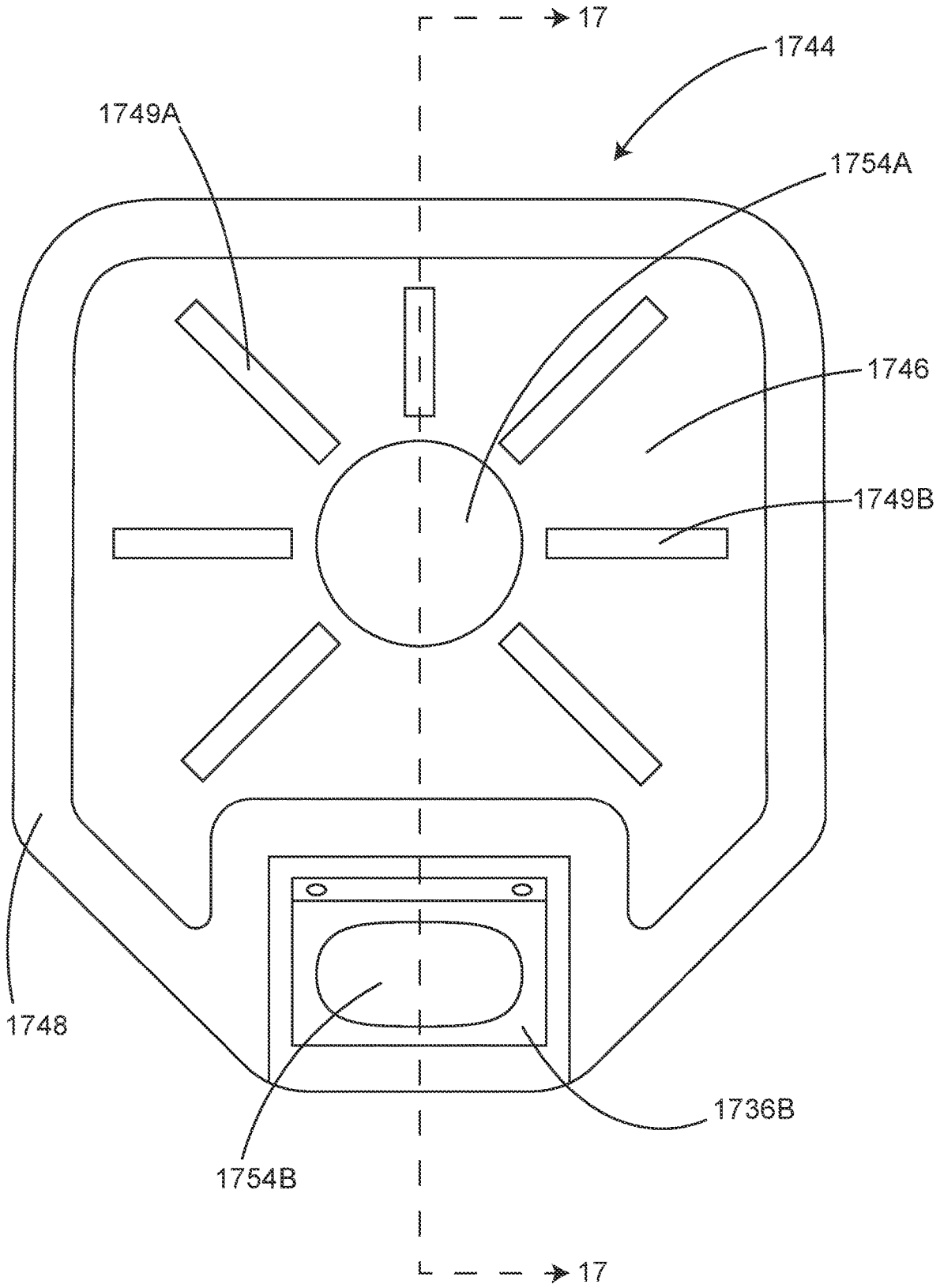
FIG. 18 shows a back view of the respirator canister of the cross section of FIG. 17, in accordance with at least one example.

FIG. 17 shows a cross-sectional view of a portion of a protective face shield with a respirator taken along line 17-17 in FIG. 18. FIG. 18 shows a back view of a respirator filter canister 1744. In some examples as shown in FIGS. 17 and 18, a filter canister 1744 may be in fluid communication with an inner chamber 1726 of a facemask 1718 by way of one or more holes 1754A, 1754B that perforate shield 1702. Air may freely pass from the inner chamber 1726 of the facemask 1718 through one or more holes (e.g., opening, aperture) 1754A, 1754B that perforate the shield 2 and then through filter canister 1744. In some examples, filter canister 1744 may include a plenum chamber 1746 for gathering inhaled air after it has passed through filter 1712 and directing it to the one or more holes 1754A that perforate the shield 1702. When ventilation air is flowing through holes 1754A that perforate the shield 1702, there may be no need for ventilation openings (e.g., ventilation openings 20 in FIG. 2) passing through the sidewalls of facemask 1718 and the ventilation openings 20 may be omitted in the example pf FIG. 17.

In some examples, the front side of plenum chamber 1746 may include a filter seat 1748 that creates an airtight seal against the back side of filter 1712. In some examples as shown in FIGS. 17 and 18, a filter retainer 1750A, C may removably engage with the filter canister 1744 to secure the filter 1712 firmly against the filter seat 1748A, B. In some examples, the compressible filter material used in filter 1712 may be squeezed between the filter seat 1748 and the filter retainer 1750 to create an airtight seal forcing the ventilation air to flow through the filter material 1712 rather than around the filter material 1712—a problem that plagues many air filters.

In some examples, the simple but secure design of the filter 1712 being squeezed between the filter seat 1748A,B and the filter retainer 1750 to create an airtight seal, allows for a simple and inexpensive filter 1712. Filter 1712 may be simply a piece of high efficiency filter material that has been die cut (or cut by other means) into a shape that matches the general shape of the filter canister 1744. The shape of the filter canister 1744 could be a simple shape like a square, oval or circle. In some examples, the shape of the filter canister 1744 could be in the outline of a product logo. For example, if the product were to be named the "COVEX SHIELD," it may be desirable to make the shape of the filter canister 1744 to look generally like a shield. In this example, the filter 1712 inside the filter canister 1744 may also be generally shield-shaped.

In some examples, the simple but secure design of the filter 1712 being squeezed between the filter seat 1748, support ribs 1749A,B (FIG. 18) and the filter retainer 1750 to create an airtight seal, not only allows for a simple and inexpensive filter 1712 but also protects the filtration efficiency of the filter media. The filtration efficiency of filter 1712 may be protected by simply placing a piece of die cut filter material into the filter canister 1744 in a substantially flat configuration. This is in contrast to many prior art respirator filters (such as 3M "N95" respirators) that heat and then thermoform the filtration media into a cup-shaped filter. The thermoforming process results in a stretching of the non-woven filter media with no assurance of the evenness of the stretching or the final configuration or the effect of the distortion on the filtration efficiency.

In some examples, the filter 1712 can face outward from the front of shield 1702. In some examples the filter 1712 may be covered with a cover 1752 (FIG. 17) or 1952 (FIG. 19) that serves to protect the filter 1712 from flying liquids and droplets and is also more visually appealing. In some examples, cover 1752 or 1952 may be closed at the top to prevent contaminates from "raining" in and onto the filter 1712. In some examples cover 1752 or 1952 may be open along its lower side to allow air to pass into filter canister 1744 and through filter 1712. In some examples, cover 1952 (FIG. 19) may be generally shield-shaped for branding and practicality.

Figure 19:
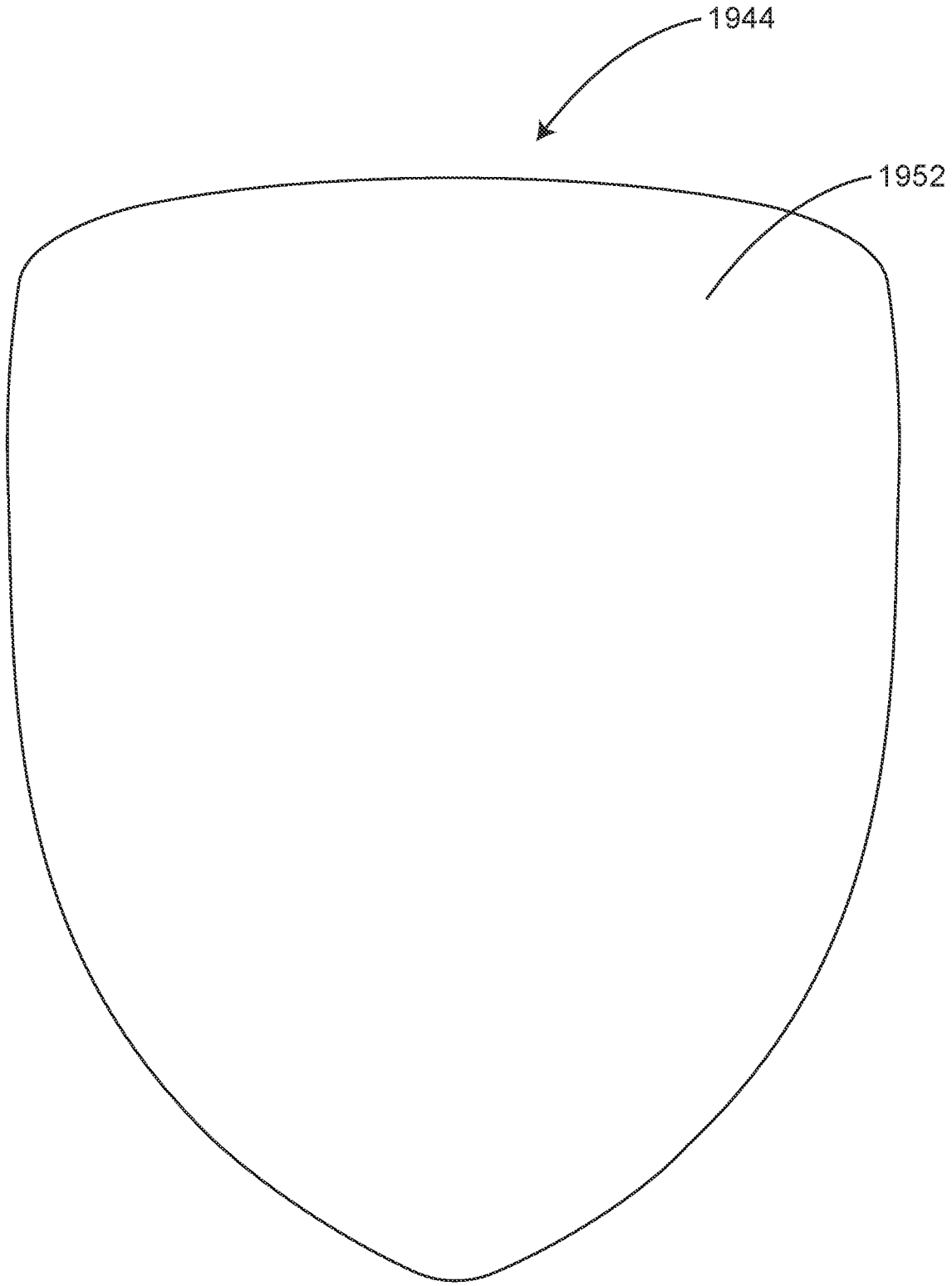
FIG. 19 shows a front view of a respirator canister, in accordance with at least one example.

As shown in FIG. 19, a generally shield-shaped cover 1952 of a respirator 1944 creates a larger cross sectional area for air inhalation along the lower open sides of the shield compared to a similar sized circular shape for example. In some examples, the filter retainer 1750A,C may be built into cover 1752 or 1952.

In some examples as shown in FIGS. 17 and 18, an expiratory valve 1736 may be built into filter canister 1744. The expiratory valve 1736 may be a flap valve for example that closes against a hole 1754B through the frame of filter canister 1744. The expiratory valve 1736 may allow exhaled air to easily escape from the inner chamber 1726 (FIG. 17) of facemask 1718, minimizing humidity and moisture buildup in the facemask 1718. Other types of one-way valves are anticipated. In some examples, a dedicated hole 1754B through face shield 1702 and into filter canister 1744 may be desirable for connecting the inner chamber 1726 to the expiratory valve 1736.

In some examples, one-way expiratory valves 1736 allow condensation of humid exhaled air to accumulate at the valve 1736. Accumulating condensation may eventually form a drop of liquid that may fall from the expiratory valve 1736. If the respirator is being worn by a surgeon during surgery, there is a possibility that the falling drop of condensation fluid could fall into the open wound. In some examples, it may be advantageous to provide a wick of absorbent material that can wick up the drop before it can fall. The wicking material could be a fibrous material such as cotton, polypropylene or other natural and synthetic materials. The wicking material could be absorbent gels or hydrocolloids. Other absorbent materials are anticipated. In some examples, an extension of the high efficiency filter material from the bottom edge of the filter 1712 may be used as the wicking material, especially since many high efficiency filter materials are made of polypropylene fibers that are known to be hydrophilic and very absorptive of water.

In some examples, it may be advantageous to attach the filter canister 1744 in a substantially central location on the face shield 1702 in order to maintain the dynamic conformability of the facemask 1718 in response to the bending of the face shield 1702 around the face (as shown against face 6, FIG. 1). For example, limiting the attachment area of the filter canister 1744 substantially to the central 50% of the internal width of the inner chamber 26 of facemask 18, allows the lateral 25% on each side to bend in response to tightening the face shield 2. In contrast, if the filter canister 1744 is most or all of the width of the facemask 1718, the stiff filter canister 1744 would effectively prevent dynamic conformability facemask 1718 in response to the bending of the face shield 1702 around the face.

In some examples, it may be desirable to attach the filter canister 1744 across substantially the entire face of the facemask 1718. This design can reduce dynamic conformability of facemask 1718 but may improve durability. Similarly, in some examples facemask 1718 could be attached directly to the filter canister 1744. This design can reduce dynamic conformability of facemask 1718 but may improve durability. In some examples, the face shield 1702 may be used as the rear wall of the filter canister 1744.

In some examples, when a filter canister 1744 is mounted on the front side of the shield 1702, the molds and the molded plastic parts that make up the filter canister 1744 and attachment pieces add cost and delay to the construction of the face shield 1702 with facemask 1718. On the other hand, when a filter canister 1744 is mounted on the front side of the shield 1702 the cost of the filter can be much less than the ribbon-like filter assembly surrounding the facemask 18, 918, 1218 (FIGS. 1-14).

Any of the examples described herein can include any combination of the features described herein. In some examples as shown in FIG. 6, with support from FIG. 1, the protective face shield 2 with respirator 4 includes optional fog diversion wings 28 A,B located on each side of the respirator 4. In some examples, the fog diversion wings 28A,B include pieces of compressible foam rubber or foam plastic attached to the back side 10 of the face shield 2. The fog diversion wings 28 A,B can be designed to be adjacent to, such as to abut the tubular filter media 12 or non-filtering fabric 938, positioned on the outside of the facemask 18 and also abut the user's cheek when worn. This arrangement allows the position of the fog diversion wings 28A, B to be customizably positioned to a user's face 6. The fog diversion wings 28A,B can therefore seal against the back surface 10 of the face shield 2, the user's face 6 and the respirator 4, with the fog diversion wings 28A,B projecting substantially laterally from the facemask 18. This arrangement can provide that the fog diversion wings 28A, B can be configured to extend generally along a cheek or cheekbone of a user when worn, creating a face-to-shield gap between the back side 10 of the shield 2 and the user's face 6. The fog diversion wings 28A,B can be configured to provide the face-to-shield gap. In some examples, the face-to-shield gap can be a tapered gap. The fog diversion wings 28A,B can be tapered. The fog diversion wings 28A,B can be tapered to provide a smaller gap medially, proximate the filter media 12, and a larger gap laterally, proximate a perimeter of the face shield 2. The fog diversion wings 28A,B can physically prevent warm, humid, exhaled air from rising up and into the field of vision, fogging the face shield 2 or the user's glasses.

In some examples, the fog diversion wings 28A, B are located on the face shield 2 to extend from laterally adjacent to the nostrils, bridge or below a user's nose, or adjacent to the filter media 12, and extend toward a user's ear when worn. In some examples the fog diversion wings 28A, B extend upward at a lateral end compared to a medial end.

In some examples as shown at least in the rear view of the device 1 in FIG. 8, the combination of the respirator 4 and fog diversion wings 28A,B projecting laterally from each side of the respirator 4, creates a physical partition between the upper 30 and lower 32 portions of the space created between the users face and the back side 10 of the face shield 2. The objective of creating the partition between the upper 30 and lower 32 portions of the space created between the users face and the back side 10 of the face shield 2 is to confine or divert the warm, humid, exhaled air laterally away from the user's face. The upper portion 30 is the field of vision that must be kept free of humidity or the user's glasses and face shield will fog, obstructing vision.

In some examples as shown in FIGS. 6 and 7, when the face shield 2 with respirator 4 is in the unworn state or a relaxed position, in other words the face shield is relatively flat compared to the worn state, the fog diversion wings 28A,B do not necessarily engage with the respirator 4, leaving a gap into which the tubular filter media 12 or non-filtering fabric 38 can be inserted. With the face shield 2 in a relaxed position, the fog diversion wings 28A,B do not prevent the insertion tubular filter media 12 around the facemask 18. When the face shield 2 is bent around the face as shown in FIG. 8, the bending causes the fog diversion wings 28A,B rotate inward to abut the respirator 4, closing the gap between the two. In some examples as shown in FIG. 8, the fog diversion wings 28A,B are abutted against the sides of the respirator 4 in the region occupied by the nose (not shown), which helps push the facemask 18 inward against the nose creating a better seal. It can be difficult to create an air seal with a ventilation mask in the area that is adjacent the nose. The fog diversion wings 28A,B can be abutted against the sides of the respirator 4 improve the seal of the facemask 18 against the face when worn. In some examples, the fog diversion wings 28A,B can be attached to the back side 10 of the shield 2. In other examples, the fog diversion wings 28A,B can be attached (affixed) to the filter 12 and form a part of a replaceable assembly including the filter 12 and fog diversion wings 28A,B. Such a replaceable assembly can be provided in a manner that looks like FIG. 8. For example, as an assembly including filter 12 and fog diversion wings 28A,B. In an example, a lateral portion of the filter 12 can be affixed to a medial portion of the fog diversion wings 28A,B. In some examples, the fog diversion wings 28A,B can include a higher friction or sticky material on an anterior surface to adhere or minimize movement relative to a back side 10 of the shield 2. High friction or sticky material can include a material that has a relatively higher coefficient of friction than a base material of the fog diversion wings 28A,B. In some examples, the fog diversion wings 28A,B can be formed of a foam, including an open cell foam that is inexpensive and provides a comfortable fit, and can be disposed of along with the filter 12 after the filter's useful life. Other foams, including, but not limited to closed cell foams may also be used.

In some examples, the fog diversion wings 28AB abutted against the sides of the respirator 4 in the region occupied by the nose, accentuate the dynamic conformability of facemask 18 by forcing the sides of facemask 18 firmly against the nose and cheeks. The fog diversion wings 28AB can abut against the cheeks of the user help to stabilize the facemask 18 and face shield 2 against the face of the user, helping to prevent movement and shifting. In some examples, the fog diversion wings 28AB abutted against the cheeks of the user help to stabilize the facemask 18 and face shield 2, preventing collapse of the face shield 2 when the user attachment 14 may be over-tightened.

In some examples as shown in FIG. 1, the user attachment 14 can be designed to connect behind the neck of the user in contrast to the conventional tie strings that are designed to connect behind the head of the user above the ear. Tie strings that are designed to connect behind the head of the user are axiomatically pulling at a tangential angle and thus require greater tension to produce the same seal pressure against the face 6. The self-supporting shape of the facemask 18 of this disclosure seats on the bridge of the nose and thus does not require a "lifting" force directed at the back of the head to maintain its position on the face 6. The force securing facemask 18 of this disclosure can be directed rearward to the back of the neck. Since this force in substantially perpendicular to the plane of the face much less tension is required to produce an adequate seal pressure against the face. Less tension equates to more comfort for the user, both on the neck and the face.

Most if not all prior art respirators use elastic or stretchable rubber securement straps. The non-compliant and non-stretching fabric N95 respirators or hard molded shell respirators require stretchable elastic or rubber straps in order to hold the respirator tightly against the face. These elastic straps are stretchable but generally not adjustable. Therefore, they must be sized to provide significant pressure pulling the respirator against the face. One of the most common complaints about N95 respirators for example is that they squeeze your head until it feels like it will burst.

In some examples, the user attachment 14 (e.g., user attachment members) of this disclosure are made of cord, string or shoelace material. In some examples, the user attachment 14 are made of parachute cord. In some examples, the user attachment 14 are made of substantially non-stretching material and the "stretch" effect necessary to provide a comfortable fit comes from a "spring-like" effect that is provided by a combination of the compression of the foam facemask 18 and fog diversion wings 28, and the bending or flexion of the face shield 2 around the face. The spring-like compressibility of the foam and the flexion of the face shield 2 allows for the user attachment 14 to be non-stretchable. The non-stretching user attachment 14 allow for much more precise adjustment of the tension of the facemask 18 against the face compared to prior art elastic bands. The more precise adjustment of the tension of the facemask 18 against the face compared to prior art elastic bands results in a more comfortable fit.

In some examples, the tie strings of user attachment 14 are designed to connect behind the neck of the user by tying the two ends together. In some examples, the tie strings (e.g., 14) are designed to connect behind the neck of the user by slip beads or neck cord locks readily available on the market. The advantage of slip beads or neck cord locks may be that they allow the ties strings to be loosened and yet remain connected to each other. Therefore, the user can loosen the tie strings but leave the connected ends behind their neck, conveniently allowing the face shield with respirator to hang down against their chest or abdomen when not in use. When hanging against the chest or abdomen, the face shield 2 is uniquely facing outward, protecting the facemask 18 from contamination. This is in contrast to conventional facemasks that rely on both upper and lower tie strings to function properly. Traditionally the upper string is slipped up and over the top of the head allowing the facemask to rest upon the chest supported by the lower tie strings. In this position, the facemask is backwards with the side that normally touches the face oriented forward where it can be easily contaminated. Added stability during hanging storage on the chest can be added to facemask 18 by cutting slots, indentations or hooks into the upper corners of the face shield 2 to accommodate the tie strings.

With reference to FIG. 1, the device 1 can include protected locations on which branding, a logo, emoji or images to distract a patient, or other graphics can be located. Some example protected locations are denoted by "x". For example, graphics can be disposed on an anterior (outer) surface of the fog diversion wings 28A,B, the respirator 4 or the face mask 18. Graphics can also be displayed on an outer surface of a filter 12.

Figure 10:
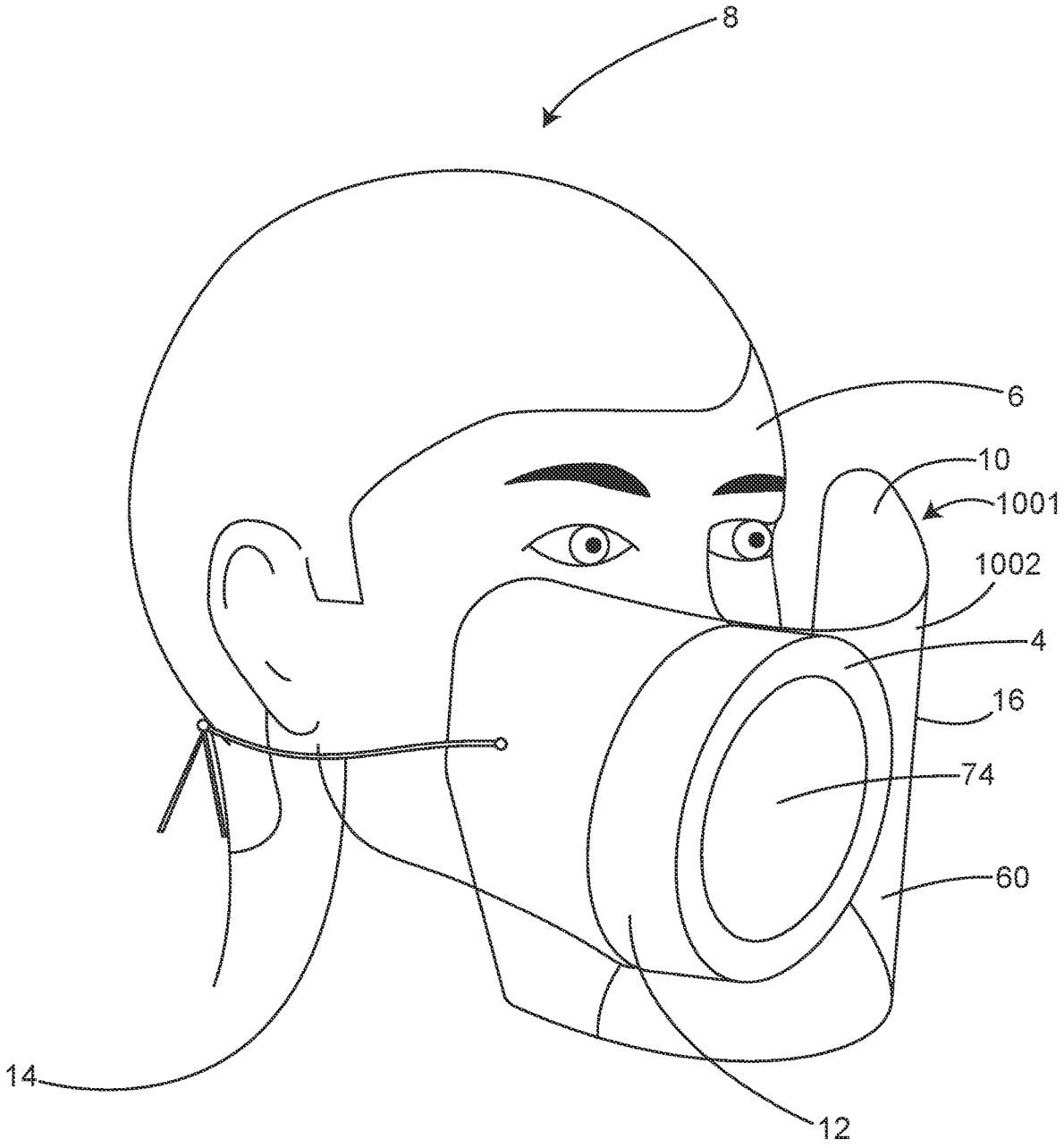
FIG. 10 shows a perspective view of a third example of a device including a protective face shield with a respirator, in accordance with at least one example.

FIG. 10 shows a perspective view of a third example of a device including a protective face shield with respirator. In some examples as shown in FIG. 10, a device 1001 can include any of the features of the device 1 described herein, with like numerals in device 1001 representing like elements of the device 1, if eye protection is not needed or wanted, the upper part of the face shield 2 may be omitted or removed, leaving a comfortable and highly effective facemask 18 and the lower half of the face shield 1002. The facemask 18 with the lower half of face shield 1002 may be preferred for use during many activities of daily living, airline travel, public transportation, industrial uses and any other activity that may require breathing protection. The facemask 18 with the lower half of face shield 1002 shown in FIG. 10 has many advantages over prior art facemasks, including: more comfortable, superior filtration, no fogging of glasses and no muffling of spoken sound.

Figure 20:
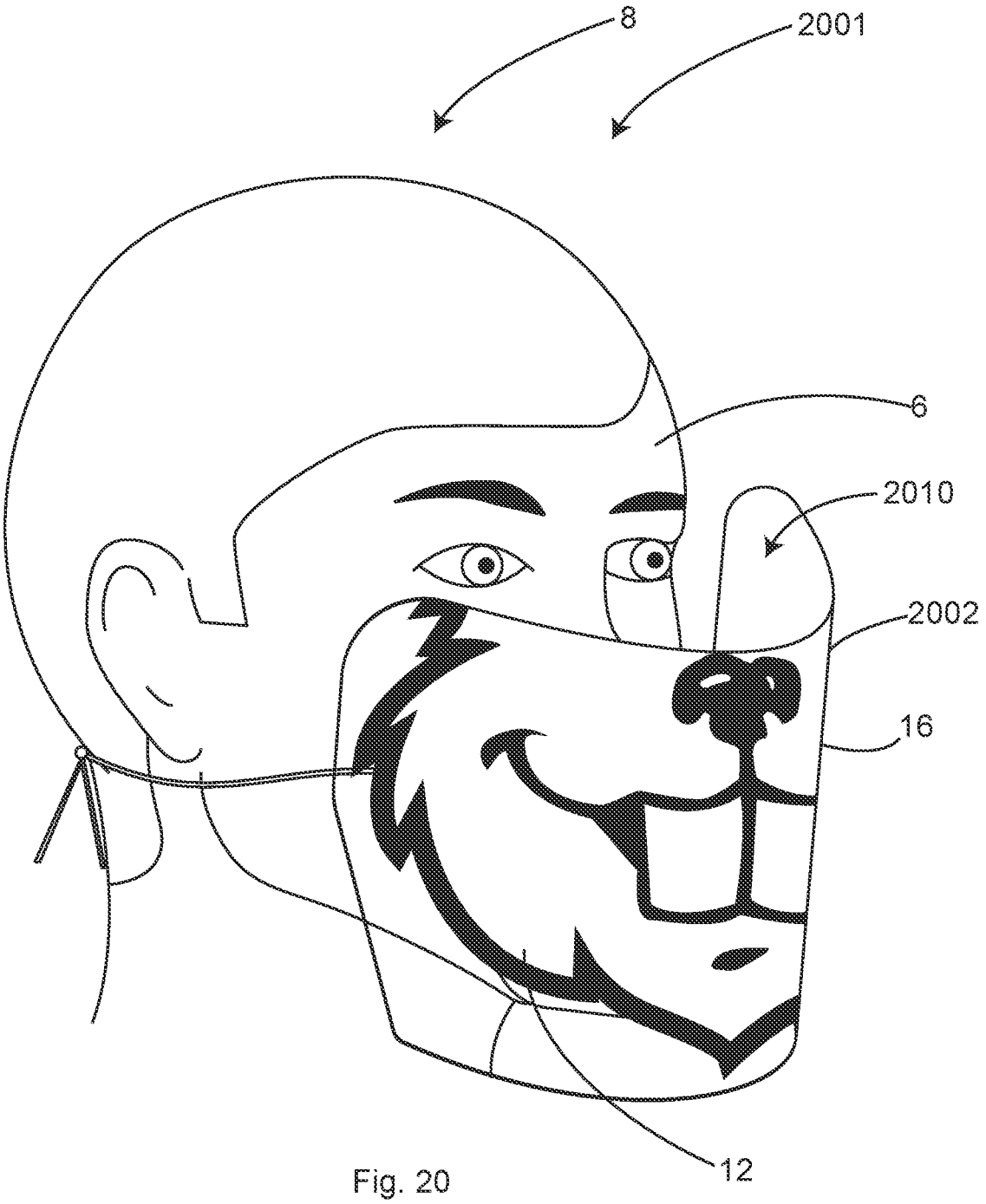
FIG. 20 shows a front view of seventh example of a device including a protective face shield and a respirator, in accordance with at least one example.

FIG. 20 shows a front view of seventh example of a device 2001 including a protective face shield 2002 and a respirator (hidden). In some examples as shown in FIG. 20, a facemask according to any of the examples described herein, such as facemask 18 of FIG. 1, can be paired with a smaller shield 2002, such as the lower half of face shield 2002 may be ideal for sporting events such as football games. During the Covid-19 pandemic for example, sporting events that result in large numbers of fans being in close proximity to each other such as football games, have been canceled. Even when these games are rescheduled, they may be played in empty stadiums. In addition to the advantages of the design of this disclosure listed above, sports fans may find that the facemask 18 with the lower half of face shield 2002 is easy and convenient to "dof" meaning that it can easily be pulled down over the nose and chin without loosening the tie strings 14, exposing the face for eating and drinking. The facemask 18 is also easy to "don" meaning that it can be pulled back up into position on the nose also without loosening the tie strings 14. Further the doffing and donning can be accomplished by grasping the sides of face shield 2002 while never touching the facemask 18 or the face.

In some examples as shown in FIG. 20, facemask 18 with the lower half of face shield 2002 may be ideal for sporting events such as football games because the uniquely smooth forward surface 16 of the face shield 2002 is an ideal surface for applying school logos, sports team logos or advertising messages. Other types of stickers and messages are anticipated including but not limited to American flags, animals and birds such as eagles, cartoon figures such as smiley faces or political messages. If the facemask 18 with the lower half of face shield 2002 of this disclosure was to be used for personal protection during an event like mardi gras, the front of the face shield 2002 may be decorated like a costume ball mask. The front of the face shield 2002 may be an ideal advertising surface for corporate sponsorship of various events. The front of the face shield 2002 may be ideal for identifying the user such as "police" or "security" or "EMS" for example. In some examples, the non-filtering fabric (e.g., 938; FIG. 9) surrounding filter 12 may be made in the school or team colors. Alternatively, in some examples, any of the shields described herein can include a transparent portion so that a user's mouth is visible to communicate expressions to others.

In some examples, the integrity of the seal of facemask 18 against the user's face 6 can be quickly and easily checked by a simple light test. If there is no decorative sticker blocking the view through the face shield 2 into the inner chamber 26 of facemask 18, a bright light (such as a cell phone light) can be shined at the outside perimeter of the seal between the facemask 18 and the face. The inspector simply looks for "light leaks" against the skin of the user within the inner chamber 26 of facemask 18. Any visible light projecting from the outside perimeter to the inside of the facemask 18 that is visible against the skin, indicates a poor gasket seal of the facemask 18 against the face. This test can advantageously be done if the face shield 2 includes a filter canister 44 in front of the shield 2 as shown in FIG. 15. The filter canister 44 may include one or more holes 54AB that communicate between the filter canister 44 and the inner chamber 26 of facemask 18. The inspector can look through these one or more holes 54AB, into the inner chamber 26 of facemask 18 when looking for "light leaks" against the skin.

In some examples, the elegantly simple yet effective design and construction of this disclosure may even allow a user to make a "homemade" face shield and respirator in an emergency. This is in sharp contrast to other high efficiency filter masks such as N-95 and N-100 filter masks that require large machines in a factory to produce. The simple yet effective design and construction of this disclosure may be an ideal solution during a world-wide COVID-19 pandemic for example, when the entire world is exhausting the supply of personal protective equipment, especially face masks and face shields for health care workers.

VARIOUS NOTES AND EXAMPLES

Relative terms described herein, such as, "about" or "substantially" may be used to indicate a possible variation of ±10% in a stated numeric value, or a manufacturing variation.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventor also contemplates examples in which only those elements shown or described are provided. Moreover, the present inventor also contemplates examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

Example 1 is a protective face shield with respirator comprising: a transparent, elastically deformable polymeric shield configured to be located in front of a face a user when worn, the shield having a front side configured to face away from the user and a back side configured to face towards the face of the user when worn, the shield being sized to cover some or all of the face; and a respirator attached to the back side of the shield, the respirator comprising: a substantially tubular mask comprising a compressible foam, wherein a first end portion of the tubular mask is bonded to the back side of the shield and a second end portion of the tubular mask is oriented rearward creating a rear surface for engaging with the face and surrounding a nose and a mouth of the user; and at least one ventilation opening that traverses through a wall of the tubular mask, and wherein the tubular mask is configured to receive a ribbon of air filter media that wraps at least partially around the tubular mask covering some or all of an outside surface of the tubular mask.

In Example 2, the subject matter of Example 1 includes, wherein the shield has no ventilation opening.

In Example 3, the subject matter of Examples 1-2 includes, wherein the shield is smooth except for an exhaust valve that traverses the wall of the mask to allow exhaled air to exit with minimal condensation within the mask.

In Example 4, the subject matter of Examples 1-3 includes, wherein the rear surface of the tubular mask deforms from a substantially circular shape to a substantially oval shape to improve engagement with the face when the shield is deformed around the face of the user.

In Example 5, the subject matter of Examples 1-4 includes, wherein a ribbon of air filter media wraps around the outside of the tubular mask covering substantially all of the outside surface of the tubular mask.

In Example 6, the subject matter of Examples 1-5 includes, wherein a ribbon of air filter media wraps partially around the outside surface of the tubular mask covering at least a region of the ventilation opening and a ribbon of less air filtering fabric or elastic wraps around a remaining surface of the tubular mask.

In Example 7, the subject matter of Examples 1-6 includes, wherein a ribbon of air filter media wraps partially around the outside surface of the tubular mask covering at least a region of the ventilation opening and is held in place by an overlaying ribbon of less air filtering fabric that wraps around the outside of the tubular mask and the air filter media covering substantially all of the outside surface of the tubular mask.

In Example 8, the subject matter of Example 7 includes, wherein the overlaying ribbon of less air filtering fabric that wraps around the outside of the tubular mask and overlaying the air filter media holding the air filter media in position against the ventilation opening in the tubular mask in a holding state, wherein the overlaying ribbon of less air filtering fabric is elastically deformable to stretch from an unstressed state to an installation state, and elastically return to the holding state.

In Example 9, the subject matter of Examples 1-8 includes, wherein two or more foam wings are attached to the back of the shield adjacent the filter and the face of the user when worn, the wings extending laterally away from the tubular mask to divert humid exhaled air away from a field of vision of the user.

In Example 10, the subject matter of Examples 1-9 includes, wherein the ventilation opening is limited to a lower two-thirds of the tubular mask in order to prevent humid exhaled air from venting into a field of vision of the user.

In Example 11, the subject matter of Examples 1-10 includes, wherein tie straps are attached near lateral edges of the shield and are configured to connect behind a neck causing the tubular mask to be pulled snuggly against the face when tightened and when ties straps are loosened, allowing the protective face shield with respirator to hang around a user's neck and rest against a user's chest with the shield forward away from the user to prevent contamination of the respirator.

Example 12 is a protective face shield with respirator system comprising: a transparent, elastically deformable polymeric shield configured to be located in front of a face of a user when worn, the shield having a front side configured to face away from the user and a back side configured to face towards the face of a user when worn, the shield being sized to cover some or all of the face; and a respirator attached to the back side of the shield, the respirator comprising: a substantially tubular mask comprising a compressible foam, wherein one end of the tubular mask is attached to the back side of the shield and another end of the tubular mask is oriented rearward creating an rear surface configured to engage with a face of a user to surround a nose and mouth of the user; and at least one ventilation opening that traverses through a wall of the tubular mask, wherein the tubular mask is configured to receive an air filter media that is located outside of the tubular mask and is oriented to filter the ventilation air passing through the ventilation opening, and wherein the rear surface of the tubular mask deforms from a substantially circular shape to a substantially oval shape to improve engagement with the face when the shield is elastically deformed to wrap around the face of the user when worn.

In Example 13, the subject matter of Example 12 includes, wherein the shield has no ventilation-related holes.

In Example 14, the subject matter of Examples 12-13 includes, wherein the shield is smooth except for an exhaust valve that traverses the wall of the tubular mask to allow exhaled air to exit with minimal condensation within the tubular mask.

In Example 15, the subject matter of Examples 12-14 includes, wherein a ribbon of air filter media wraps around an outside perimeter surface of the tubular mask covering substantially all of the outside perimeter surface of the tubular mask.

In Example 16, the subject matter of Examples 12-15 includes, wherein a ribbon of air filter media wraps partially around an outside perimeter of the tubular mask covering at least a region of the ventilation opening and a ribbon of less air filtering fabric or elastic wraps around at least a remaining surface of the tubular mask.

In Example 17, the subject matter of Examples 12-16 includes, wherein a ribbon of air filter media wraps partially around an outside perimeter of the tubular mask covering at least a region of the ventilation opening and is held in place by an overlaying ribbon of less air filtering fabric that wraps around the outside perimeter of the tubular mask and the air filter media covering substantially all of an outside perimeter surface of the tubular mask.

In Example 18, the subject matter of Example 17 includes, the overlaying ribbon of less air filtering fabric that wraps around the outside of the tubular mask and overlaying the air filter media holding the air filter media in position against the ventilation opening in the tubular mask in a holding state, wherein the overlaying ribbon of less air filtering fabric is elastically deformable to stretch from an unstressed state to an installation state, and elastically return to the holding state.

In Example 19, the subject matter of Examples 12-18 includes, wherein two or more foam wings are attached to the back of the shield adjacent the filter and the face and extending laterally away from the tubular mask to divert humid exhaled air away from the field of vision.

In Example 20, the subject matter of Examples 12-19 includes, wherein the ventilation opening is limited to a lower two-thirds of the tubular mask in order to prevent humid exhaled air from venting into the field of vision.

In Example 21, the subject matter of Examples 12-20 includes, wherein attachment members are attached near lateral edges of the shield and are configured to connect behind a neck of the user causing the tubular mask to be pulled snuggly against the face when tightened and when the attachment members are loosened, the protective face shield with respirator can rest against a user's chest with the front side of the shield facing away from the user to prevent contamination of the respirator.

Example 22 is an air filter to be used with a respirator facemask, the air filter comprising: a ribbon of air filter media, wherein a width of the ribbon of filter media approximates a depth of a respirator facemask, wherein a length of the ribbon of filter media approximates some or all of an outer perimeter of the respirator facemask, and wherein the ribbon of air filter media can be wrapped around at least a portion of an outer perimeter surface of a respirator facemask to filter air traversing through at least one ventilation opening in a wall of the respirator facemask.

In Example 23, the subject matter of Example 22 includes, wherein a ribbon of air filter media wraps partially around the outer perimeter of the respirator facemask covering at least a region of the ventilation opening and is held in place by an overlaying ribbon of less air filtering fabric that wraps around an outside of the respirator facemask and the air filter media covering substantially all of the outer perimeter surface of the respirator facemask.

In Example 24, the subject matter of Examples 22-23 includes, wherein two end portions of the ribbon of air filter media are joined to two end portions of a ribbon of less air filtering fabric or elastic which together form a substantially tubular shape that snuggly fits over and surrounds an outer perimeter surface of a respirator facemask.

In Example 25, the subject matter of Examples 22-24 includes, wherein the ribbon of air filter media surrounds some or all of the outer perimeter of a respirator facemask and wherein two ends of the ribbon of air filter media are attachable to the respirator facemask with adhesive or hook and loop fastener.

Example 26 is at least one machine-readable medium including instructions that, when executed by processing circuitry, cause the processing circuitry to perform operations to implement of any of Examples 1-25.

Example 27 is an apparatus comprising means to implement of any of Examples 1-25.

Example 28 is a system to implement of any of Examples 1-25.

Example 29 is a method to implement of any of Examples 1-25.

What is claimed is:

1. A protective device comprising:

a transparent, elastically deformable polymeric shield configured to be located in front of a face a user when worn, the shield having a front side configured to face away from the user and a back side configured to face towards the face of the user when worn, the shield being sized to cover some or all of the face; and a respirator attached to the back side of the shield, the respirator comprising:

a substantially tubular mask comprising a compressible foam, wherein a first end portion of the tubular mask is bonded to the back side of the shield and a second end portion of the tubular mask is oriented rearward creating a rear surface for engaging with the face and surrounding the nose and the mouth of the user; and at least one ventilation opening that traverses through a wall of the tubular mask, and wherein a ribbon of air filter media wraps around some or substantially all of an outside surface of the tubular mask covering at least a region of the at least one ventilation opening and a ribbon of less air filtering fabric or elastic wraps around at least a remaining surface of the outside surface of the tubular mask.

2. The protective device of claim 1, wherein the shield is smooth except for an exhaust valve that traverses the wall of the mask to allow exhaled air to exit with minimal condensation within the mask.

3. The protective device of claim 1, wherein the rear surface of the tubular mask deforms from a substantially circular shape to a substantially oval shape to improve engagement with the face when the shield is deformed around the face of the user.

4. The protective device of claim 1, wherein the ribbon of air filter media wraps around the outside surface of the tubular mask covering substantially all of the outside surface of the tubular mask.

5. The protective device of claim 1, wherein the ribbon of air filter media wraps partially around the outside surface of the tubular mask covering at least a region of the at least one ventilation opening and is held in place by the ribbon of less air filtering fabric that wraps around the outside surface of the tubular mask and the air filter media covering substantially all of the outside surface of the tubular mask.

6. The protective device of claim 5, wherein the ribbon of less air filtering fabric that wraps around the outside surface of the tubular mask and overlays the air filter media holding the air filter media in position against the at least one ventilation opening in the tubular mask in a holding state, wherein the ribbon of less air filtering fabric is elastically deformable to stretch from an unstressed state to an installation state, and elastically return to the holding state.

7. The protective device of claim 1, wherein two or more foam wings are attached to the back side of the shield adjacent the filter media and the face of the user when worn, the wings extending laterally away from the tubular mask to divert humid exhaled air away from a field of vision of the user.

8. The protective device of claim 1, wherein the at least one ventilation opening is limited to a lower two-thirds of the tubular mask in order to prevent humid exhaled air from venting into a field of vision of the user.

9. The protective device of claim 1, wherein tie straps are attached near lateral edges of the shield and are configured to connect behind a neck causing the tubular mask to be pulled snuggly against the face when tightened and when the tie straps are loosened, allowing the shield and respirator to hang around the user's neck and rest against the user's chest with the shield forward away from the user to prevent contamination of the respirator.

10. A protective device comprising:

a transparent, elastically deformable polymeric shield configured to be located in front of a face of a user when worn, the shield having a front side configured to face away from the user and a back side configured to face towards the face of the user when worn, the shield being sized to cover some or all of the face; and a respirator attached to the back side of the shield, the respirator comprising:

a substantially tubular mask comprising a compressible foam, wherein one end of the tubular mask is attached to the back side of the shield and another end of the tubular mask is oriented rearward creating an rear surface configured to engage with the face of the user to surround the nose and mouth of the user; and at least one ventilation opening that traverses through a wall of the tubular mask, wherein a ribbon of air filter media wraps around some or substantially all of an outside perimeter of the tubular mask covering at least a region of the at least one ventilation opening and a ribbon of less air filtering fabric or elastic wraps around at least a remaining surface of the outside perimeter of the tubular mask, wherein the tubular mask is configured to receive the air filter media that is located outside of the tubular mask and is oriented to filter the ventilation air passing through the at least one ventilation opening, and wherein the rear surface of the tubular mask deforms from a substantially circular shape to a substantially oval shape to improve engagement with the face when the shield is elastically deformed to wrap around the face of the user when worn.

11. The protective device of claim 10, wherein the shield is smooth except for an exhaust valve that traverses the wall of the tubular mask to allow exhaled air to exit with minimal condensation within the tubular mask.

12. The protective device of claim 10, wherein the ribbon of air filter media wraps around the outside perimeter of the tubular mask covering substantially all of the outside perimeter of the tubular mask.

13. The protective device of claim 10, wherein the ribbon of air filter media wraps partially around the outside perimeter of the tubular mask covering at least a region of the at least one ventilation opening and is held in place by the ribbon of less air filtering fabric that wraps around the outside perimeter of the tubular mask and the air filter media covering substantially all of the outside perimeter of the tubular mask.

14. The protective device of claim 13, the ribbon of less air filtering fabric that wraps around the outside perimeter of the tubular mask and overlays the air filter media holding the air filter media in position against the at least one ventilation opening in the tubular mask in a holding state, wherein the ribbon of less air filtering fabric is elastically deformable to stretch from an unstressed state to an installation state, and elastically return to the holding state.

15. The protective device of claim 10, wherein two or more foam wings are attached to the back side of the shield adjacent the filter media and the face and extending laterally away from the tubular mask to divert humid exhaled air away from the field of vision.

16. The protective device of claim 10, wherein the at least one ventilation opening is limited to a lower two-thirds of the tubular mask in order to prevent humid exhaled air from venting into the field of vision.

17. The protective device of claim 10, wherein attachment members are attached near lateral edges of the shield and are configured to connect behind the neck of the user causing the tubular mask to be pulled snuggly against the face when tightened and when the attachment members are loosened, the shield and respirator can rest against the user's chest with the front side of the shield facing away from the user to prevent contamination of the respirator.

18. An air filter to be used with a respirator facemask, the air filter comprising:

a ribbon of air filter media, wherein a width of the ribbon of filter media approximates a depth of a respirator facemask, wherein a length of the ribbon of filter media approximates some or all of an outer perimeter of the respirator facemask, and wherein the ribbon of air filter media is configured to be wrapped around some or substantially all of the outer perimeter of the respirator facemask to filter air traversing through at least one ventilation opening in a wall of the respirator facemask, and wherein the ribbon of air filter media wraps around some or substantially all of the outer perimeter of the respirator facemask covering at least a region of the at least one ventilation opening and is held in place by an overlaying ribbon of less air filtering fabric or elastic that wraps around the outer perimeter of the respirator facemask.

19. The air filter of claim 18, wherein two end portions of the ribbon of air filter media are joined to two end portions of the ribbon of less air filtering fabric or elastic which together form a substantially tubular shape that snuggly fits over and surrounds the outer perimeter of the respirator facemask.

20. The air filter of claim 18, wherein two ends of the ribbon of air filter media are attachable to the respirator facemask with adhesive or hook and loop fastener.

21. An air filter to be used with a respirator facemask, the air filter comprising:

a ribbon of air filter media, wherein a width of the ribbon of filter media approximates a depth of a respirator facemask, wherein a length of the ribbon of filter media approximates some or all of an outer perimeter of the respirator facemask, and wherein the ribbon of air filter media is configured to be wrapped around some or substantially all of the outer perimeter surface of the respirator facemask to filter air traversing through at least one ventilation opening in a wall of the respirator facemask, and wherein two end portions of the ribbon of air filter media are joined to two end portions of the ribbon of less air filtering fabric which together form a substantially tubular shape that snuggly fits over and surrounds the outer perimeter of the respirator facemask.

* * * * *